US011933491B2

(12) United States Patent
Zala et al.

(10) Patent No.: US 11,933,491 B2
(45) Date of Patent: Mar. 19, 2024

(54) BURNER WITH ADJUSTABLE END CAP AND METHOD OF OPERATING SAME

(71) Applicant: The Cleaver-Brooks Company, Inc., Thomasville, GA (US)

(72) Inventors: Rakesh Zala, Thomasville, GA (US); Steven L. Whirry, Thomasville, GA (US); Mark T. Salentine, Thomasville, GA (US)

(73) Assignee: The Cleaver-Brooks Company, LLC, Thomasville, GA (US)

( * ) Notice: Subject to any disclaimer, the term of this patent is extended or adjusted under 35 U.S.C. 154(b) by 1301 days.

(21) Appl. No.: 16/455,253

(22) Filed: Jun. 27, 2019

(65) Prior Publication Data

US 2019/0323706 A1 Oct. 24, 2019

Related U.S. Application Data

(63) Continuation of application No. 15/175,987, filed on Jun. 7, 2016, now abandoned.

(51) Int. Cl.
*F23C 9/08* (2006.01)
*F22B 7/00* (2006.01)
(Continued)

(52) U.S. Cl.
CPC ..... *F23C 9/08* (2013.01); *F22B 7/00* (2013.01); *F22B 9/08* (2013.01); *F22B 13/04* (2013.01);
(Continued)

(58) Field of Classification Search
CPC ..... F24H 1/282; F24H 1/285; F23D 11/406; F23D 2900/11401
See application file for complete search history.

(56) References Cited

U.S. PATENT DOCUMENTS 657,579 A 9/1900 White
725,408 A 4/1903 Chapman
(Continued)

FOREIGN PATENT DOCUMENTS

CN 2641531 9/2004
CN 204648658 9/2015
(Continued)

OTHER PUBLICATIONS

Chinese Rejection Decision from the State Intellectual Property Office of China for Application No. 201680086501.3 dated Sep. 24, 2020 (7 pages).
(Continued)

*Primary Examiner* — Jorge A Pereiro
(74) *Attorney, Agent, or Firm* — Amundsen Davis, LLC

(57) ABSTRACT

A boiler system comprises a housing with a generally cylindrical shape extends between first and second walls to provide a generally cylindrical space. A fire tube is positioned near a bottom of the generally cylindrical housing and extends longitudinally from a first wall of the cylindrical housing to a fire tube end wall. The boiler system also includes a burner with a generally cylindrical housing which defines a generally cylindrical chamber and an end plate. The burner extends into the fire tube, and the fire tube provides a combustion chamber where combustion of an air-fuel mixture is accomplished using the burner. The end plate of the burner is adjustable so as to adjust the flame that extends from within the burner housing into the fire tube.

20 Claims, 13 Drawing Sheets

(51) Int. Cl.

| | |
|---|---|
| ***F22B 9/08*** | (2006.01) |
| ***F22B 13/04*** | (2006.01) |
| ***F23B 30/00*** | (2006.01) |
| ***F23C 3/00*** | (2006.01) |
| ***F24H 1/26*** | (2022.01) |

(52) U.S. Cl.
CPC ..... *F23B 1/00* (2013.01); *F23C 3/002* (2013.01); *F23C 3/004* (2013.01); *F24H 1/26* (2013.01)

(56) References Cited

U.S. PATENT DOCUMENTS

| | | | | |
|---|---|---|---|---|
| 823,836 | A * | 6/1906 | Wiemann | F23D 11/10 431/186 |
| 1,684,991 | A * | 9/1928 | Inglis | F23C 99/00 431/65 |
| 2,183,836 | A * | 12/1939 | Gordon, Jr. | F23C 99/00 431/167 |
| 2,220,603 | A * | 11/1940 | Hirtz | F23D 11/001 431/350 |
| 3,123,127 | A * | 3/1964 | Willott | F23D 14/00 431/177 |
| 3,638,621 | A * | 2/1972 | Craig | F22B 7/14 122/149 |
| 3,782,884 | A * | 1/1974 | Shumaker | F23D 14/22 239/456 |
| 3,799,734 | A | 3/1974 | Bailey | |
| 3,868,211 | A | 2/1975 | Haye et al. | |
| 4,029,057 | A * | 6/1977 | Frechette nee Bussieres | F24H 1/285 122/149 |
| 4,373,901 | A * | 2/1983 | Kaplan | F23D 14/70 431/350 |
| 4,519,770 | A * | 5/1985 | Kesselring | F23D 14/18 431/170 |
| 4,531,461 | A | 7/1985 | Sayler et al. | |
| 4,714,052 | A * | 12/1987 | Gilfaut | F24H 1/285 122/149 |
| 4,771,762 | A * | 9/1988 | Bridegum | F24H 1/285 122/75 |
| 4,884,963 | A | 12/1989 | Kardos | |
| 4,995,807 | A | 2/1991 | Rampley et al. | |
| 5,275,554 | A | 1/1994 | Faulkner | |
| 5,511,971 | A | 4/1996 | Benz et al. | |
| 5,562,438 | A | 10/1996 | Gordon et al. | |
| 6,039,560 | A | 3/2000 | Kubota | |
| 6,162,049 | A | 12/2000 | Pellizzari | |
| 6,347,935 | B1 | 2/2002 | Schindler et al. | |
| 6,558,153 | B2 * | 5/2003 | Schutz | F23C 9/08 431/115 |
| 6,565,361 | B2 | 5/2003 | Jones et al. | |
| 8,784,096 | B2 | 7/2014 | Mosiewicz | |
| 8,794,960 | B2 | 8/2014 | Lifshits et al. | |
| 10,253,977 | B2 * | 4/2019 | Goh | F23D 14/70 |
| 2001/0031440 | A1 * | 10/2001 | Fullemann | F23D 11/40 122/18.31 |
| 2006/0057518 | A1 | 3/2006 | Aldrich | |
| 2006/0147854 | A1 | 7/2006 | Fullemann | |
| 2011/0076629 | A1 * | 3/2011 | Mosiewicz | F24H 1/282 431/174 |
| 2012/0003595 | A1 * | 1/2012 | Goh | F24H 9/0026 431/177 |
| 2016/0334137 | A1 * | 11/2016 | Pisani | F28F 1/08 |

FOREIGN PATENT DOCUMENTS

| | | | |
|---|---|---|---|
| DE | 3832322 | | 3/1990 |
| EP | 0347797 | A1 * | 12/1989 |
| WO | 2015112950 | | 7/2015 |

OTHER PUBLICATIONS

Second Office Action from the State Intellectual Property Office of China for Application No. 2016800865013 dated Mar. 31, 2020 (23 pages).

First Office Action from the State Intellectual Property Office of China for Application No. 2016800865013 dated Aug. 22, 2019 (22 pages).

PCT/US2016/036247 International Search Report and Written Opinion of the International Searching Authority dated Mar. 17, 2017.

* cited by examiner

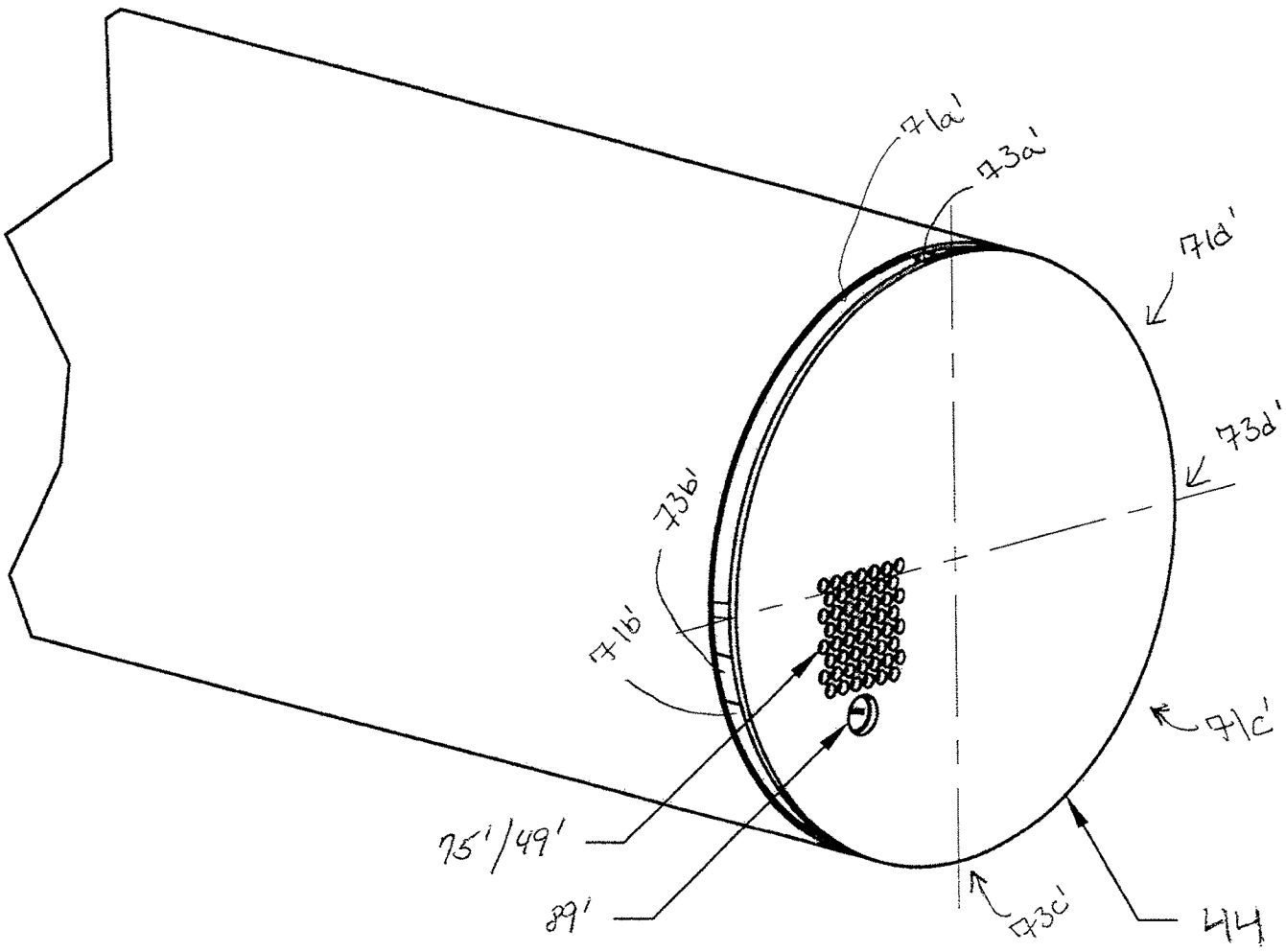
44
42c'
42d'
42a'
42b'
42e'
42f'
42g'
42h'
42i'
42j'
42k'
42l'
42m'
42n'
42o'
42p'
42q'
42r'
42s'
42t'
42u'
42v'
42w'
42x'
42y'
42z'
42aa'
42ab'
42ac'
42ad'
42ae'
42af'
42ag'
42ah'
42ai'
42aj'
42ak'
42al'
42am'
42an'
42ao'
42ap'
42aq'
42ar'
42as'
42at'
42au'
42av'
42aw'
42ax'
42ay'
42az'
42ba'
42bb'
42bc'
42bd'
42be'
42bf'
42bg'
42bh'
42bi'
42bj'
42bk'
42bl'
42bm'
42bn'
42bo'
42bp'
42bq'
42br'
42bs'
42bt'
42bu'
42bv'
42bw'
42bx'
42by'
42bz'
42ca'
42cb'
42cc'
42cd'
42ce'
42cf'
42cg'
42ch'
42ci'
42cj'
42ck'
42cl'
42cm'
42cn'
42co'
42cp'
42cq'
42cr'
42cs'
42ct'
42cu'
42cv'
42cw'
42cx'
42cy'
42cz'
42da'
42db'
42dc'
42dd'
42de'
42df'
42dg'
42dh'
42di'
42dj'
42dk'
42dl'
42dm'
42dn'
42do'
42dp'
42dq'
42dr'
42ds'
42dt'
42du'
42dv'
42dw'
42dx'
42dy'
42dz'
42ea'
42eb'
42ec'
42ed'
42ee'
42ef'
42eg'
42eh'
42ei'
42ej'
42ek'
42el'
42em'
42en'
42eo'
42ep'
42eq'
42er'
42es'
42et'
42eu'
42ev'
42ew'
42ex'
42ey'
42ez'
42fa'
42fb'
42fc'
42fd'
42fe'
42ff'
42fg'
42fh'
42fi'
42fj'
42fk'
42fl'
42fm'
42fn'
42fo'
42fp'
42fq'
42fr'
42fs'
42ft'
42fu'
42fv'
42fw'
42fx'
42fy'
42fz'
42ga'
42gb'
42gc'
42gd'
42ge'
42gf'
42gg'
42gh'
42gi'
42gj'
42gk'
42gl'
42gm'
42gn'
42go'
42gp'
42gq'
42gr'
42gs'
42gt'
42gu'
42gv'
42gw'
42gx'
42gy'
42gz'
42ha'
42hb'
42hc'
42hd'
42he'
42hf'
42hg'
42hh'
42hi'
42hj'
42hk'
42hl'
42hm'
42hn'
42ho'
42hp'
42hq'
42hr'
42hs'
42ht'
42hu'
42hv'
42hw'
42hx'
42hy'
42hz'
42ia'
42ib'
42ic'
42id'
42ie'
42if'
42ig'
42ih'
42ii'
42ij'
42ik'
42il'
42im'
42in'
42io'
42ip'
42iq'
42ir'
42is'
42it'
42iu'
42iv'
42iw'
42ix'
42iy'
42iz'
42ja'
42jb'
42jc'
42jd'
42je'
42jf'
42jg'
42jh'
42ji'
42jj'
42jk'
42jl'
42jm'
42jn'
42jo'
42jp'
42jq'
42jr'
42js'
42jt'
42ju'
42jv'
42jw'
42jx'
42jy'
42jz'
42ka'
42kb'
42kc'
42kd'
42ke'
42kf'
42kg'
42kh'
42ki'
42kj'
42kk'
42kl'
42km'
42kn'
42ko'
42kp'
42kq'
42kr'
42ks'
42kt'
42ku'
42kv'
42kw'
42kx'
42ky'
42kz'
42la'
42lb'
42lc'
42ld'
42le'
42lf'
42lg'
42lh'
42li'
42lj'
42lk'
42ll'
42lm'
42ln'
42lo'
42lp'
42lq'
42lr'
42ls'
42lt'
42lu'
42lv'
42lw'
42lx'
42ly'
42lz'
42ma'
42mb'
42mc'
42md'
42me'
42mf'
42mg'
42mh'
42mi'
42mj'
42mk'
42ml'
42mm'
42mn'
42mo'
42mp'
42mq'
42mr'
42ms'
42mt'
42mu'
42mv'
42mw'
42mx'
42my'
42mz'
42na'
42nb'
42nc'
42nd'
42ne'
42nf'
42ng'
42nh'
42ni'
42nj'
42nk'
42nl'
42nm'
42nn'
42no'
42np'
42nq'
42nr'
42ns'
42nt'
42nu'
42nv'
42nw'
42nx'
42ny'
42nz'
42oa'
42ob'
42oc'
42od'
42oe'
42of'
42og'
42oh'
42oi'
42oj'
42ok'
42ol'
42om'
42on'
42oo'
42op'
42oq'
42or'
42os'
42ot'
42ou'
42ov'
42ow'
42ox'
42oy'
42oz'
42pa'
42pb'
42pc'
42pd'
42pe'
42pf'
42pg'
42ph'
42pi'
42pj'
42pk'
42pl'
42pm'
42pn'
42po'
42pp'
42pq'
42pr'
42ps'
42pt'
42pu'
42pv'
42pw'
42px'
42py'
42pz'
42qa'
42qb'
42qc'
42qd'
42qe'
42qf'
42qg'
42qh'
42qi'
42qj'
42qk'
42ql'
42qm'
42qn'
42qo'
42qp'
42qq'
42qr'
42qs'
42qt'
42qu'
42qv'
42qw'
42qx'
42qy'
42qz'
42ra'
42rb'
42rc'
42rd'
42re'
42rf'
42rg'
42rh'
42ri'
42rj'
42rk'
42rl'
42rm'
42rn'
42ro'
42rp'
42rq'
42rr'
42rs'
42rt'
42ru'
42rv'
42rw'
42rx'
42ry'
42rz'
42sa'
42sb'
42sc'
42sd'
42se'
42sf'
42sg'
42sh'
42si'
42sj'
42sk'
42sl'
42sm'
42sn'
42so'
42sp'
42sq'
42sr'
42ss'
42st'
42su'
42sv'
42sw'
42sx'
42sy'
42sz'
42ta'
42tb'
42tc'
42td'
42te'
42tf'
42tg'
42th'
42ti'
42tj'
42tk'
42tl'
42tm'
42tn'
42to'
42tp'
42tq'
42tr'
42ts'
42tt'
42tu'
42tv'
42tw'
42tx'
42ty'
42tz'
42ua'
42ub'
42uc'
42ud'
42ue'
42uf'
42ug'
42uh'
42ui'
42uj'
42uk'
42ul'
42um'
42un'
42uo'
42up'
42uq'
42ur'
42us'
42ut'
42uu'
42uv'
42uw'
42ux'
42uy'
42uz'
42va'
42vb'
42vc'
42vd'
42ve'
42vf'
42vg'
42vh'
42vi'
42vj'
42vk'
42vl'
42vm'
42vn'
42vo'
42vp'
42vq'
42vr'
42vs'
42vt'
42vu'
42vv'
42vw'
42vx'
42vy'
42vz'
42wa'
42wb'
42wc'
42wd'
42we'
42wf'
42wg'
42wh'
42wi'
42wj'
42wk'
42wl'
42wm'
42wn'
42wo'
42wp'
42wq'
42wr'
42ws'
42wt'
42wu'
42wv'
42ww'
42wx'
42wy'
42wz'
42xa'
42xb'
42xc'
42xd'
42xe'
42xf'
42xg'
42xh'
42xi'
42xj'
42xk'
42xl'
42xm'
42xn'
42xo'
42xp'
42xq'
42xr'
42xs'
42xt'
42xu'
42xv'
42xw'
42xx'
42xy'
42xz'
42ya'
42yb'
42yc'
42yd'
42ye'
42yf'
42yg'
42yh'
42yi'
42yj'
42yk'
42yl'
42ym'
42yn'
42yo'
42yp'
42yq'
42yr'
42ys'
42yt'
42yu'
42yv'
42yw'
42yx'
42yy'
42yz'
42za'
42zb'
42zc'
42zd'
42ze'
42zf'
42zg'
42zh'
42zi'
42zj'
42zk'
42zl'
42zm'
42zn'
42zo'
42zp'
42zq'
42zr'
42zs'
42zt'
42zu'
42zv'
42zw'
42zx'
42zy'
42zz

BURNER WITH ADJUSTABLE END CAP AND METHOD OF OPERATING SAME

FIELD

The present invention relates to boiler systems that employ combustion processes and, more particularly, to improved burner and burner-boiler systems for hot water and steam applications and associated methods of operation.

BACKGROUND

Boiler systems that employ combustion processes to generate heat are commonly employed in a variety of environments. Fire tube boilers or boiler furnaces typically have a combustion chamber encompassed within a vessel or water tank and a plurality of heat transfer tubes passing through the vessel for conducting heated or hot combustion gases resulting from combustion of an air-fuel mixture by a burner, typically located at the front of the boiler. The hot combustion gases are typically passed from the front of the boiler, to the rear, and back to the front. Additional passes, using additional tubes, may be provided within the boiler to accomplish complete heat exchange.

Because boiler furnaces can run at different levels (e.g., high fire, mid fire, low fire, etc.), it is desirable to achieve complete consumption (or as close to as possible) of fuel. For example, boiler furnaces run at different levels depending on the desired resultant temperature to be reached. In order to obtain higher temperatures (or to increase temperature quickly), boiler furnaces are run at high fire states, meaning a large volume of fuel/air mixture is combusted. Similarly, if a smaller or more gradual increase in temperature is desired, it may not be necessary to run the furnace at a high fire state, provided an adequate amount of fuel is consumed at the lower fire state. One skilled in the art will recognize that the closer to complete fuel consumption a boiler system achieves, the more efficient (and lower cost) the system will be.

Further, conventional fire tube boiler systems adjust the amount of combustion (e.g., flame size) and therefore total heat transfer by adjusting the amount of fuel/air which flows into the burner. In some instances, it is beneficial to have a second means of controlling combustion/flame size by adjusting the size of the openings in the burner.

Because convention fire tube boiler systems operate through combustion, such systems necessarily generate an amount of $NO_x$ emissions. In order to reduce $NO_x$ emissions, it is known to recirculate flue gas into the combustible fuel/air mixture to, essentially, recycle at least a portion of the flue gas. It is desirable to combine flue gas recirculation with the above efficiencies (e.g., improved fuel consumption and improved flame control).

In view of one or more such limitations that exist in relation to conventional fire tube boiler systems, it would be advantageous if improvements could be achieved in relation to such boiler systems and related methods of operation.

SUMMARY

The present disclosure, in at least some embodiments, relates to a boiler system comprising: a housing having a generally cylindrical shape and extending between first and second walls to provide a generally cylindrical space; a fire tube positioned near a bottom of the generally cylindrical housing and extending longitudinally from a first wall of the cylindrical housing to a fire tube end wall, a burner having a generally cylindrical housing and an end plate, the housing defining a generally cylindrical chamber; wherein the fire tube provides a combustion chamber where combustion of an air-fuel mixture is accomplished using the burner, the burner extending into the fire tube; and wherein the end plate of the burner is adjustable so as to adjust the flame that extends from within the burner housing into the fire tube.

Additionally, the present disclosure, at least in some embodiments, relates to a burner system for use with a boiler system, the burner system comprising: a burner comprising a burner housing having a generally cylindrical shape and extending from a first end wall to a second end wall; the burner extending into a fire tube of a boiler; wherein the second end wall of the burner housing is adjustable so as to adjust the flame that extends from within the burner housing into the boiler fire tube.

In at least some embodiments, the present disclosure further relates to a process for heating a medium using a boiler system, the process comprising: establishing a pilot flame by determining whether an end cap of a burner is in a minimum gap position and, if not, moving the end cap to the minimum gap position; increasing the firing rate of the boiler system by moving the end cap to a predefined position; and maintaining firing of the boiler system with the end cap at the predefined position.

Other embodiments are contemplated and considered to be within the scope of the present disclosure.

BRIEF DESCRIPTION OF THE DRAWINGS

Features of the present disclosure which are believed to be novel are set forth with particularity in the appended claims. Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings:

FIG. 10 shows an end cap of a boiler system similar to the boiler system of FIG. 2 in further detail, in accordance with one example embodiment encompassed herein.

DETAILED DESCRIPTION

Figure 1A:
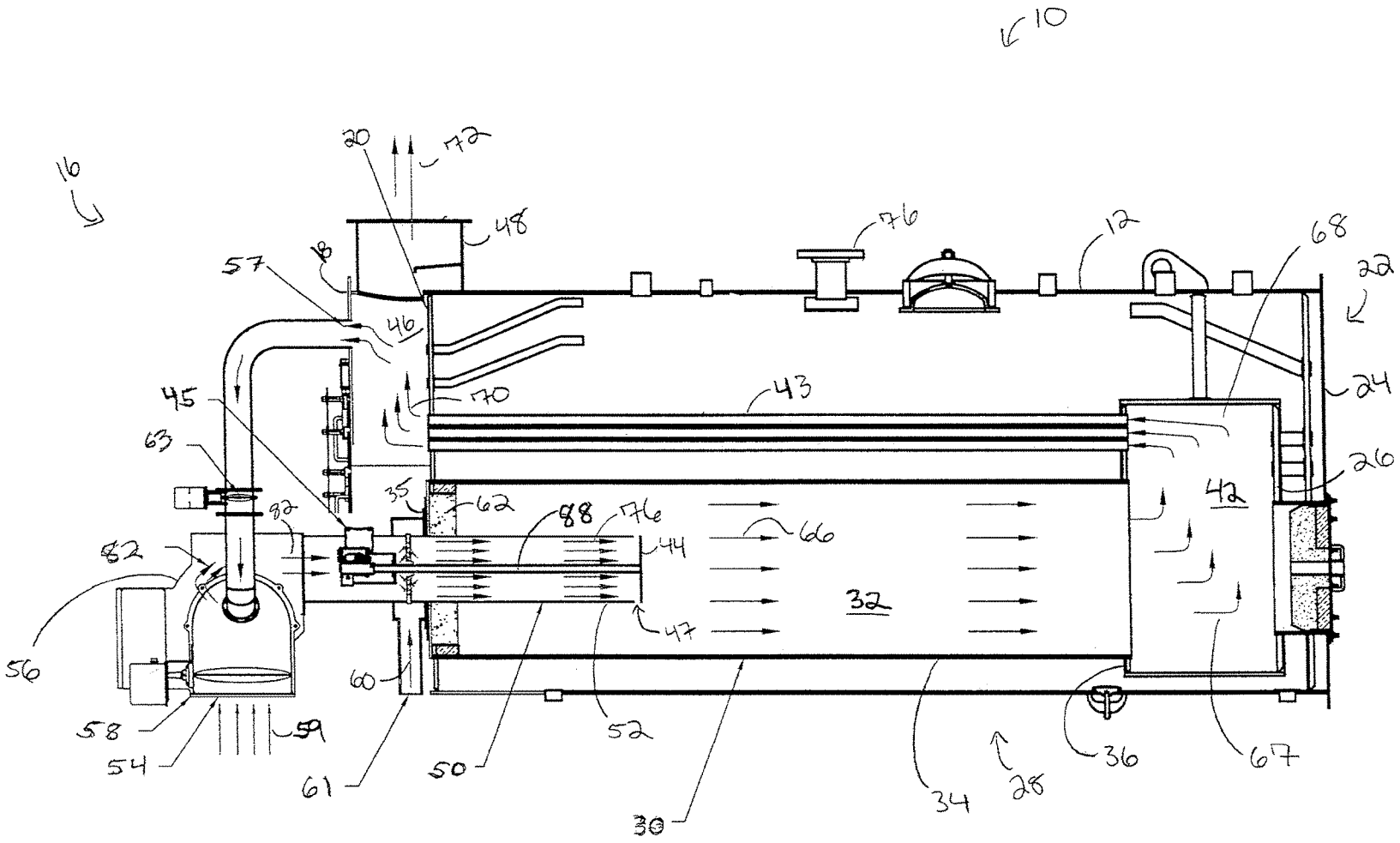
FIG. 1A is a schematic diagram of a boiler system in accordance with one example embodiment encompassed herein.
Figure 9:
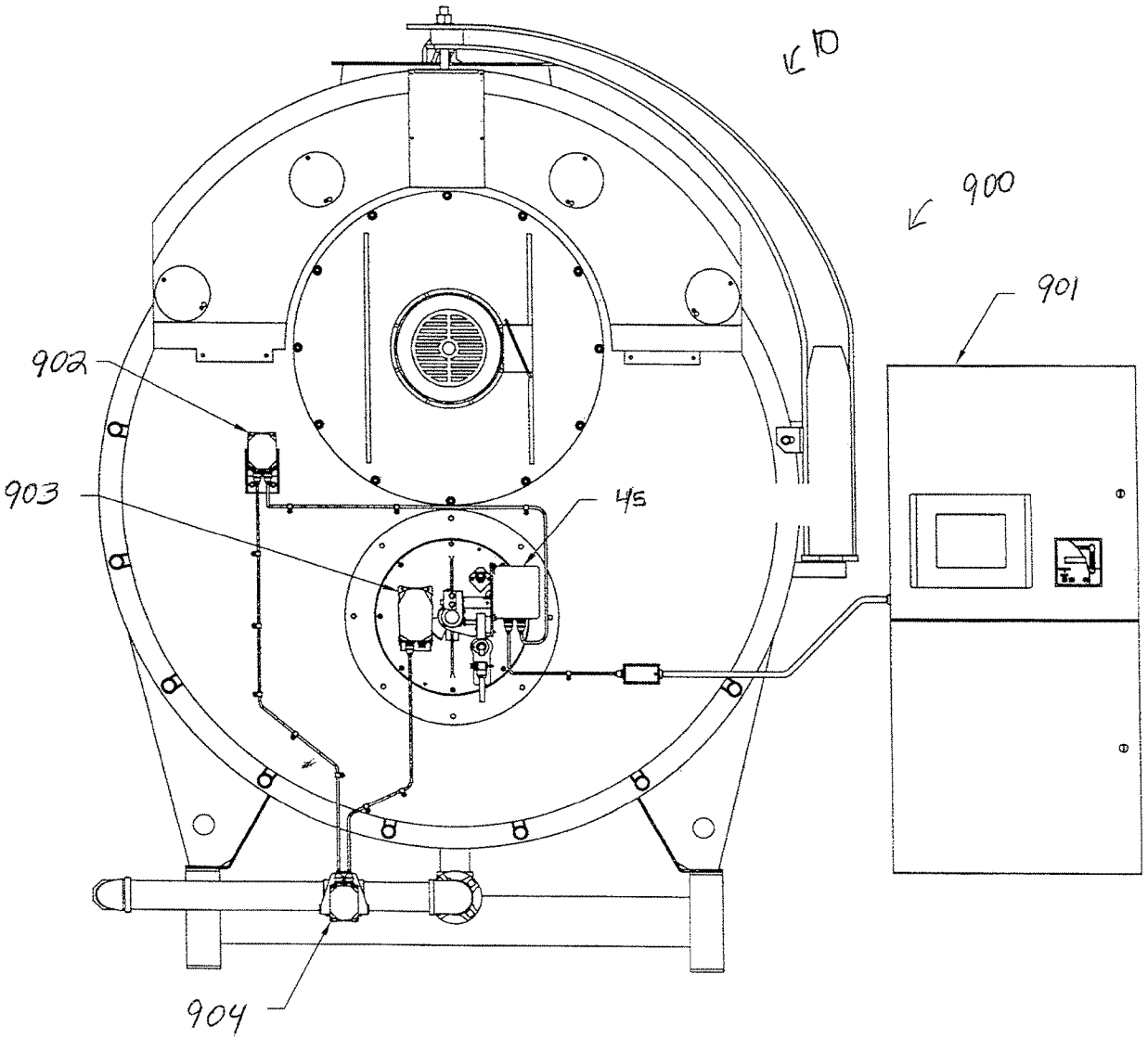
FIG. 9 is a schematic diagram of a boiler system, similar to the boiler system of FIG. 2 showing the system with an exemplary control assembly, in accordance with one example embodiment encompassed herein.

FIG. 1A shows a schematic diagram of a boiler system (or "boiler"), generally referenced by numeral 10, in accordance with one example embodiment encompassed herein. With reference to this Figure, the boiler 10 employs, in accordance with at least some embodiments, a housing or shell 12 with, as shown in the present embodiment, a generally cylindrical shape, and includes a circumference. In typical use situations, the boiler housing or shell 12 is mounted upon an appropriate base structure 14 (FIG. 9). At or near its front end 16, the boiler 10 is formed or otherwise provided with an outer front end wall 18 and an inner front end wall 20, which can in at least some embodiments take the form of a tube sheet, spaced longitudinally of the boiler 10 with respect to the outer front end wall. Similarly, at or near its rear end 22, the boiler 10 is formed or otherwise provided with an outer rear end wall 24 and an inner rear end wall 26 and which again can in at least some embodiments take the form of a tube sheet. As described further below, the shell 12, together with the inner front and rear end walls 20, 26 form the substantially tank or vessel that contains water that is to be heated.

Extending longitudinally (and as shown horizontally) of the boiler 10 and generally mounted within the shell 12 and generally near its bottom 28 is a main or fire tube or furnace 30, which provides a combustion chamber or heat-transfer tube 32 that also serves as an air/fuel mixing chamber. The combustion chamber 32 is generally bounded by a shell structure 34, which in the present embodiment takes a cylindrical shape having a circumference. The shell structure 34 extends longitudinally from the front furnace end wall 35 which, in the present embodiment is a portion of the front inner end wall 20, and to a furnace end wall 36, where the rear end wall 36 can, in at least some embodiments, take the form of a tube sheet.

As shown, for example, in FIG. 1A, the furnace 30, and particularly the shell structure 34 of the furnace 30, is substantially smooth. However, in further embodiments, including, for example, as shown and described with respect to FIG. 3, the furnace 30, and particularly the shell structure 34, may be corrugated. Corrugation adds strength to the furnace 30, particularly as the length of the furnace 30 increases. The exact properties of the corrugations (e.g., depth of ridges, number of peaks per distance, peak shape, etc.) may vary depending upon the application and, in some embodiments, may not impart a significant change in strength and/or flow of heated combustion gases.

At or near its front end wall 35, the fire tube 30 opens to accommodate a burner 50 (FIG. 1A), described in greater detail herein. While in the embodiments shown, the burner 50 is used in relation to a boiler, it is understood that the burner 50 (and, indeed, burners 50'/50", described with reference to FIGS. 2 and 3, below) may be used in a boiler, a fire-tube heater, a hot-water heater, a liquid-solution heater, or any other suitable device.

The burner 50 may also be retrofitted onto an existing device to replace a less efficient air-fuel burner or a higher $NO_x$ producing burner. The fire tube 30 extends to the furnace end wall 36 and opens to a turnaround space 42 between the furnace end wall 36 and inner rear end wall 26 of the boiler 10. In accordance with at least some embodiments, the rear outer end wall 24 and/or inner rear end wall 26 are constructed so that they can be opened, for example as a hinged door, to permit access to the turnaround space 42 and/or other features or structures of the boiler 10, and thus in at least such embodiments can be described as an access door.

Also extending longitudinally (and as shown horizontally) of the boiler 10 is a set of tubes, generally referenced by numeral 43. While shown in FIG. 1A as being located generally above the fire tube 30 and generally spanning a length extending from the furnace end wall 36 to the inner front end wall 20, it is to be understood that FIG. 1A illustrates a cross-section and tubes from the set of tubes 43 may be positioned above, about and/or next to the furnace 30, as shown, for example, in FIG. 1B. Moreover, the set of tubes 43 are open to a space forward of the inner front end wall 20 of the boiler 10, generally referenced by number 46, which space provides access to an exhaust or stack outlet 48.

Figure 1B:
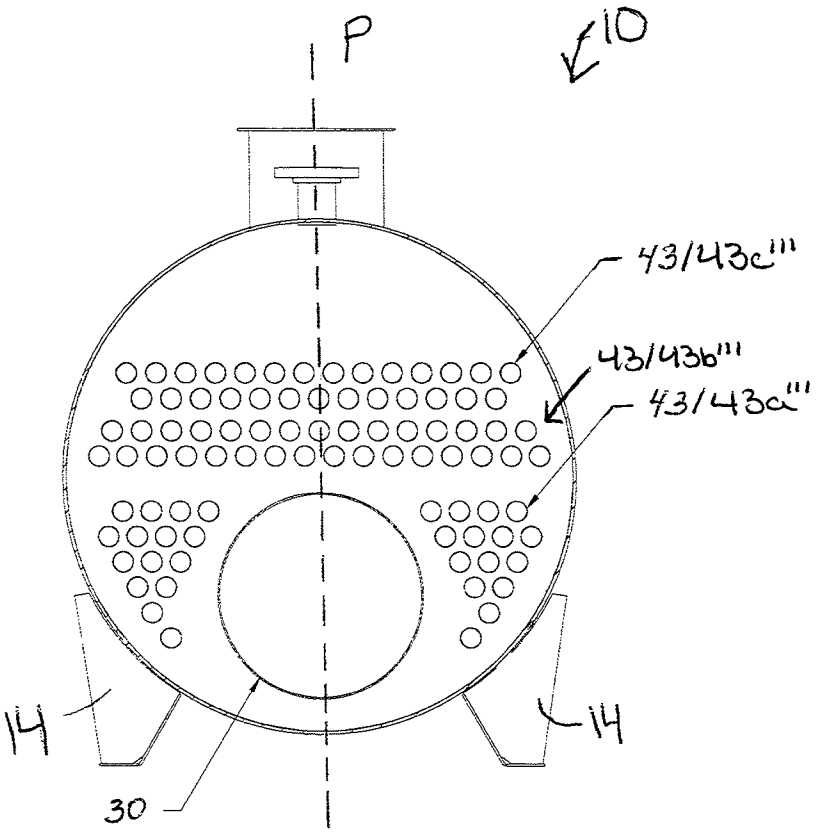
FIG. 1B is an end view schematic diagram of a boiler system in accordance with FIG. 1A.

In accordance with further embodiments, such as, for example, shown in FIG. 1B, the shell structure 34 of the furnace 30 is centered with respect to the housing 12 of the boiler system 10 with respect to a vertical plane P, and the tubes of the set of tubes 43 are symmetrically positioned with respect to the vertical plane P. In other embodiments, the shell structure 34 of the furnace 30 may be positioned with respect to the housing 12 of the boiler system 10 such that the shell structure 34 of the furnace 30, and all of the tubes of the set of tubes 43 are circumferentially disposed about the shell structure of the furnace such that they are located above a horizontal plane of the shell structure 34 of furnace 30.

The burner 50 is provided to accomplish combustion within the main tube 30. In at least some embodiments, the burner 50 can take the form an air-fuel burner having a burner head 52 often taking the form of a cylinder adapted to receive a combustible air-fuel mixture, indicated by arrows 76. Air for the air-fuel mixture is provided by way of an air inlet 54 formed in a housing 56, which includes or provides for a damper 58 for opening or closing the air inlet to selectively provide an air flow, indicated by arrows 59.

In an embodiment, and such as shown in FIG. 1A, flue gas may also be recycled to the burner, as indicated by arrows 57. The amount of flue gas which is recycled to the burner is controlled by the flue gas recirculation valve 63. Fuel, such as gas (e.g., natural gas) is provided, as indicated by arrows 60, to the burner 50 from a fuel source (not shown) by way of a fuel inlet 61. The air-fuel gas mixture is provided to the burner 50 as indicated by arrows 82, where it joins with the fuel to form a combustible air-fuel mixture which is conveyed the length of the burner 50 to the first and second exits 47, 49 as indicated by arrows 76 and described later on.

In accordance with at least some embodiments, the burner 50 can be described as a "pre-mix" burner. In other words, the air, fuel and recycled flue gas (if any) is mixed in an optimum or desired ratio before it reaches the first and second exists 47, 49. In some embodiments, the air-fuel mixture represented by arrows 76 may be referred to as premix 76.

In the embodiment illustrated in FIG. 1A, burner 50 the takes the form of a "gun" style burner arrangement. It is contemplated that, in at least some embodiments, the burner head 52 is configured to discharge the combustible air-fuel mixture, or premix, into the combustion chamber. The discharged combustible premix is ignited to produce a flame in the combustion chamber 32. The flame generates heat that heats the furnace 30 so that heat is transferred from the furnace 30 to an adjacent medium contained in the boiler 10. While the present boilers 10 described herein are described with reference to water as an exemplary adjacent medium, it is understood that other mediums, such as oil or similar fluids, may be heated using the boiler 10.

In at least some embodiments, and as shown in FIG. 1A, the burner head 52 is incorporated or provided with respect to the main or fire tube 30 by mounting the burner 50 to the main or fire tube front wall 35, so that the burner head extends into the main or fire tube. With this arrangement, the combustion chamber 32 is at least in some sense integrated with and used as part of the burner 50.

Figure 2:
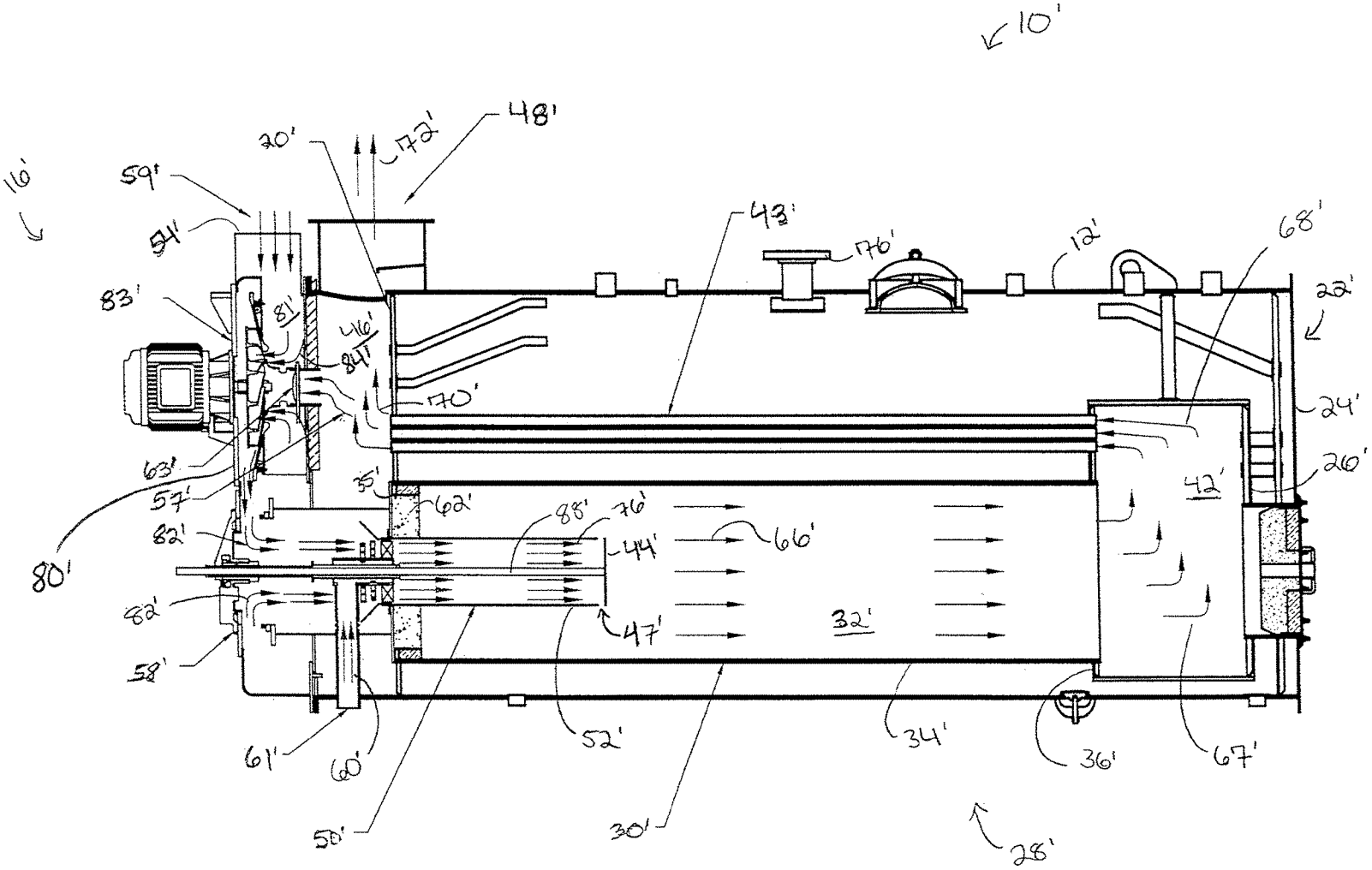
FIG. 2 is a schematic diagram of a boiler system, similar to the boiler system of FIG. 1A but showing an alternative burner arrangement in which, in accordance with one example embodiment encompassed herein.
Figure 3:
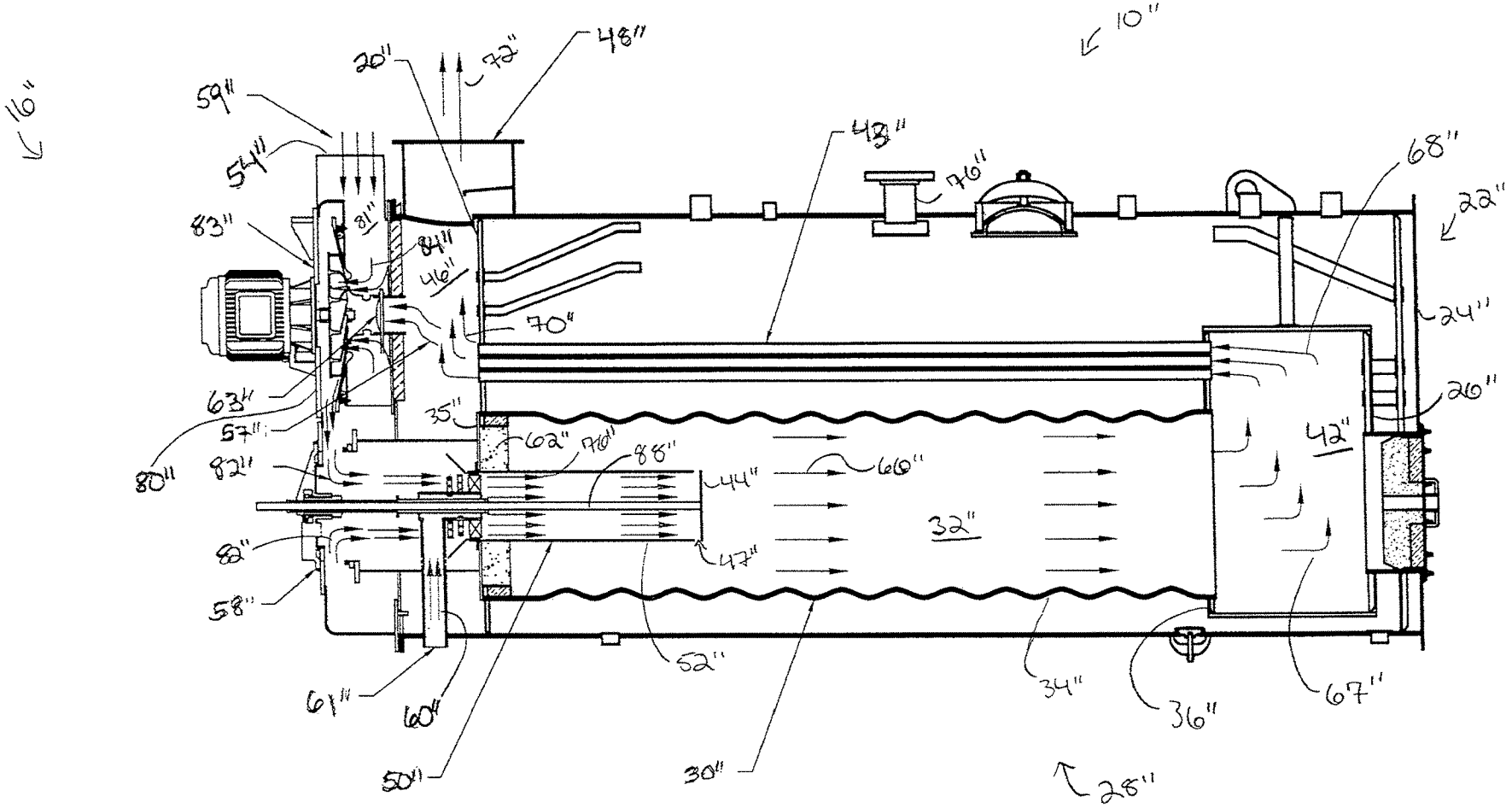
FIG. 3 is a schematic diagram of a boiler system, similar to the boiler system of FIG. 2 but showing an alternative burner arrangement in which the furnace includes corrugated side walls, in accordance with one example embodiment encompassed herein.

In a further embodiment, as shown in FIGS. 2 and 3, the boiler 10'/10" includes an integrated burner 50'/50" that is integrally provided with the boiler system. More particularly, as shown, boiler 10'/10" includes an additional front housing or head portion 80'/80" in which the burner 50'/50" is provided and which an air passage 81'/81" is provided. Air for the air-fuel mixture is provided by way of: an air inlet 54'/54" formed or provided in the front housing 80'/80". The air is drawn, via a combustion air fan 83'/83" and as shown by arrows 84'/84", towards the damper 58'/58" via the passage 81'/81". The damper 58'/58" provides again for opening or closing of the air inlet 54'/54", or more generally the air passage 81'/81", to selectively provide an air flow, indicated by arrows 59'/59". Recycled flue gas joins with the air as shown by arrows 57'/57" to form an air-flue gas mixture which is provided to the burner 50 by way of arrows 82'/82". Fuel, such as gas (e.g., natural gas) is provided, as indicated by arrows 60'/60", to the burner 50'/50" from a fuel source (not shown) by way of a fuel inlet 61'/61". In accordance with at least some embodiments, the burner 50'/50" can again be described as a "pre-mix" burner.

The difference between the embodiments shown in FIG. 2 and FIG. 3 is in the furnace 30'/30". In the embodiment shown in FIG. 2, the furnace 30' is a plain furnace, while furnace 30" shown in FIG. 3 is corrugated. As articulated above, corrugations increase the strength of the furnace 30", particularly when the length of the furnace 30" is increased.

Figure 4:
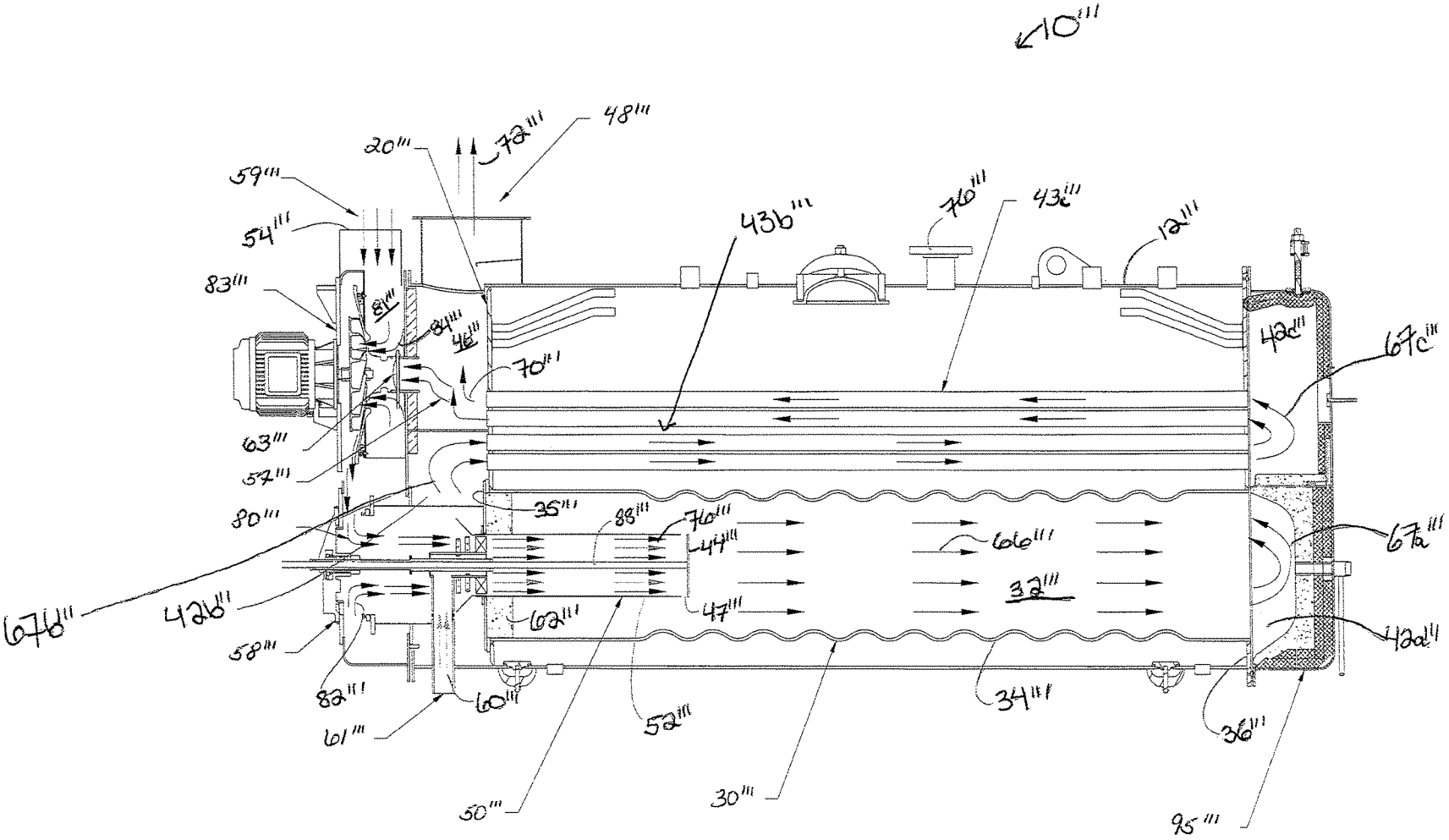
FIG. 4 is a schematic diagram of a boiler system, similar to the boiler system of FIG. 3 but showing an alternative "dry back" system in accordance with one example embodiment encompassed herein.

In the exemplary embodiments shown in FIGS. 1-3, the boiler systems 10/10'/10" are shown as having a traditional "wet back" configuration, meaning the turnaround space 42/42'/42" is substantially or completely surrounded by water or other medium which is to be heated. However, as shown in FIG. 4, the present boiler system may be used with a boiler 10'" having a traditional "dry back" configuration as well. "Dry back" boiler systems include a turnaround space 42'", as shown in FIG. 4, which is insulated 95'" (i.e., lined with refractory, or insulation).

While the overall components of the boiler system 10'" are similar or the same as those provided with respect to FIGS. 1A-3, except for as specified above, it is further shown in FIG. 4 that the configuration of the set of tubes 43'" for the boiler system 10'" must be reconfigured to cooperate with the "dry back" system. For example, as shown in FIGS. 1A, 2 and 3, the flow through the tubes of the set of tube 43/43'/43" is in a single direction. However, in FIG. 4, the heated gases 66'" (described further below) are communicated through three portions of tubes 43*a*'", 43*b*'" and 43*c*'", as shown, for example, with reference back to FIG. 1B. The gasses 66'" are first communicated rearward at turn around space 42*a*'" and through first portion of tubes 43*a*'" (see FIG. 1B). The gases then reach a second turnaround space 42*b*'" and are communicated forward, as shown by arrows 67*b*'", through a second portion of tubes 43*b*'". The gases again reverse direction at a third turnaround space 42*c*'" (as shown by arrows 67'") and enter a third portion of tubes 43*c*'".

In general, the overall components of the boiler systems 10'/10"/10'" are similar or the same as those provided with respect to FIG. 1A. Like parts are labeled with like numbers.

Also as shown, with reference to FIGS. 1-4, various regions of the boiler 10/10'/10"/10'", including over portions of its outer housing 12/12'/12"/12'" (e.g., as shown at and near its rear outer wall 26/26'/26"/26'"), is provided with insulation (refractory) discharge openings 62/62'/62"/62'". Additionally, as shown, the fire tube 30/30'/30"/30'", is, over a portion of its length, provided with an insulation (refractory) 64/64'/64"/64'" that surrounds a portion of the burner head 52/52'/52"/52'".

In accordance with embodiments of the present disclosure, the main or fire tube 30/30'/30"/30'" provides for complete combustion of heated gases, as well as passage of such heated gases to the rear portion of the fire tube 30/30'/30"/30'" and into the turnaround space 42/42'/42"/42'", with such passage or flow indicated by arrows 66/66'/66"/66'" and 67/67'/67"67'" respectively. The turnaround space 42/42'/42"/42'" provides for passage of the heated gases to the set of tubes 43/43'/43"/43'" located, as shown, above or vertically in relation to the furnace 30/30'/30"30'", which such flow indicated by arrows 68/68'/68"/68'". The set of tubes 43/43'/43"/43'" provides for passage of heated gases in to the space 46/46'/46"/46'", and then to the exhaust 48/48'/48"/48'", as indicated by arrows 70/70'/70"/70'", where the gases are discharged, as indicated by arrows 72/72'/72"/72'".

Figure 5:
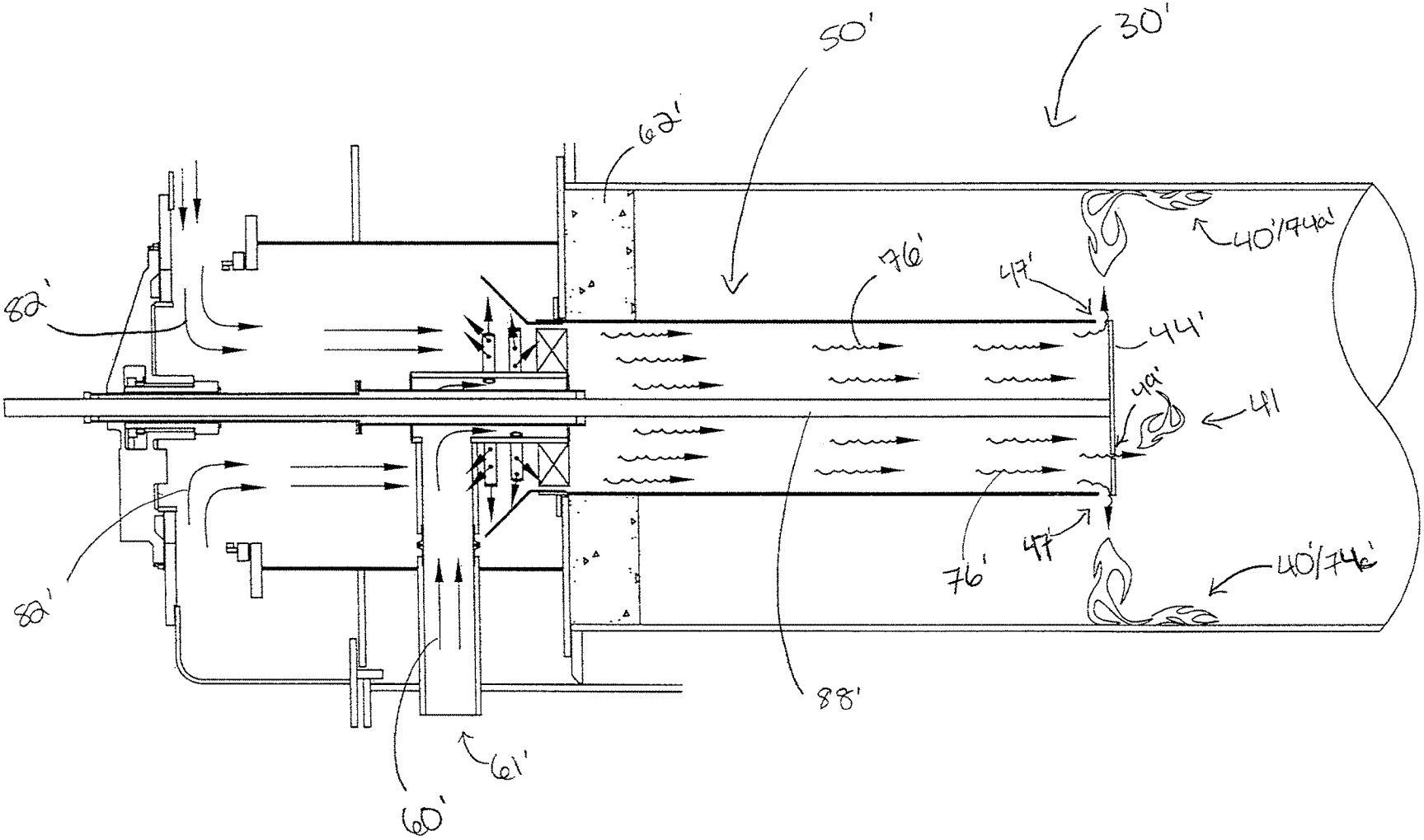
FIG. 5 is a schematic diagram of a boiler system, similar to the boiler system of FIG. 2 showing the system at a representative "low fire", in accordance with one example embodiment encompassed herein.
Figure 6A:
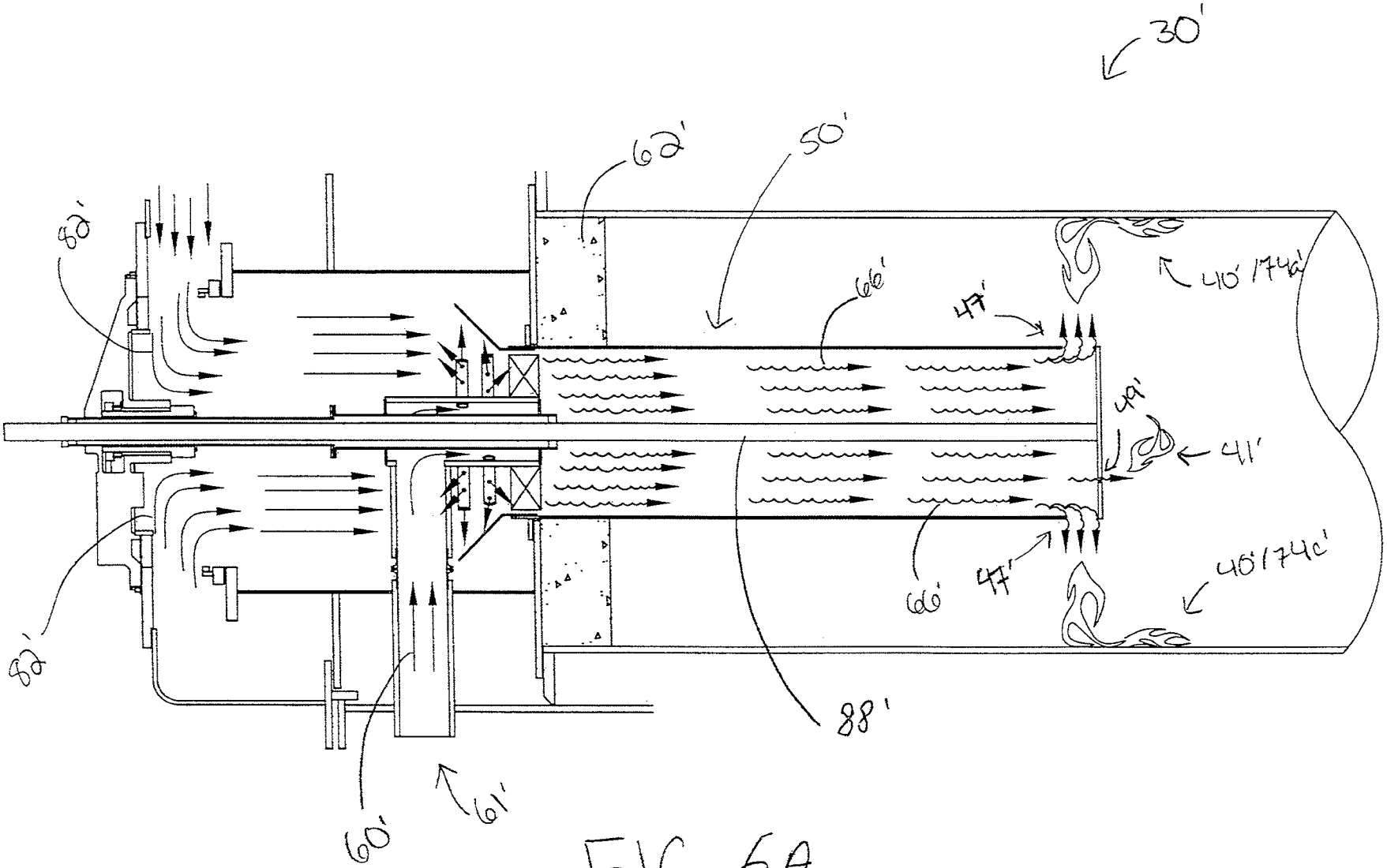
FIG. 6A is a schematic diagram of a boiler system, similar to the boiler system of FIG. 2 showing the system at a representative "high fire", in accordance with one example embodiment encompassed herein.

Now referring to the burner 50' in further detail, and with reference to FIGS. 5-6A, the rear end of the burner 50' may be considered an air-fuel nozzle comprising an end plate 44' and an endplate actuator 45' connected to the end plate 44' by post 88'. The burner 50' includes a first exit 47' which is, essentially, the gap provided between the end of the burner 50' and the end plate 44', and a second exit 49' comprising openings in the end plate 44' itself. The exits 47', 49' communicate the combustible air-fuel mixture into the combustion chamber 32'.

As shown with reference to FIGS. 5 and 6A, the first exit 47' is formed in the burner 50' and is arranged to lie downstream from the fuel inlet 61', or, in other words, downstream away from the point at which the air and fuel initially mix. The first exit 47' communicates combustible air-fuel mixture into the combustion chamber 32' to establish, when a portion of the combustible air-fuel mixture communicated from the exit 47' is ignited, a detached first flame 40' that extends radially outward from the burner 50' toward the furnace 32'. In some embodiments, the detached first flame 40' may be stabilized on the interior surface of the furnace 30', as suggested in FIGS. 5-6A.

As further shown with reference to FIGS. 5 and 6A, the second exit 49' is formed in the burner 50' and is arranged to lie in spaced-apart relation to the first exit 47' in the downstream direction. The second exit 49' communicates combustible air-fuel mixture into the combustion chamber 32' to establish, when a portion of the combustible air-fuel mixture communicated from the exit 49' is ignited, an attached second flame 41' extending in a downstream direction away from the burner head 52'. In some embodiments, the detached second flame 41' may be stabilized on the burner head 52', as suggested in FIGS. 5-6A.

Illustratively, and as mentioned above, the burner 50' comprises an end plate 44' and an end plate actuator 45', as shown perhaps most clearly in FIGS. 5-8. The burner 50' is formed as a cylinder adapted to receive a combustible air-fuel mixture. The end plate actuator 45', and particularly the post 88' of the end plate actuator 45', interconnects the end plate 44' with the burner 50'.

Figure 7:
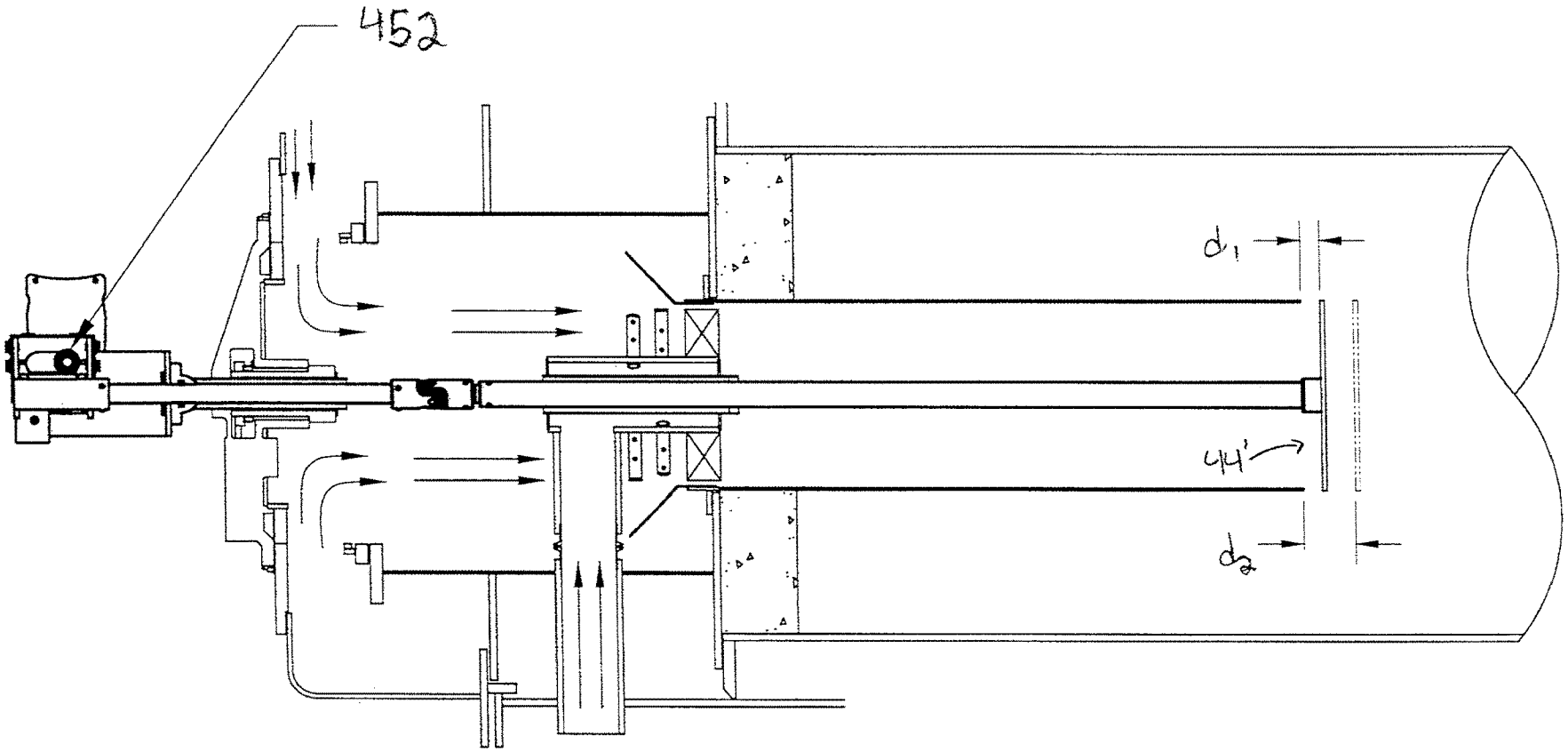
FIG. 7 is a schematic diagram of a boiler system, similar to the boiler system of FIG. 2 showing the system with an exemplary rotary actuator assembly for adjusting the end cap, in accordance with one example embodiment encompassed herein.
Figure 8:
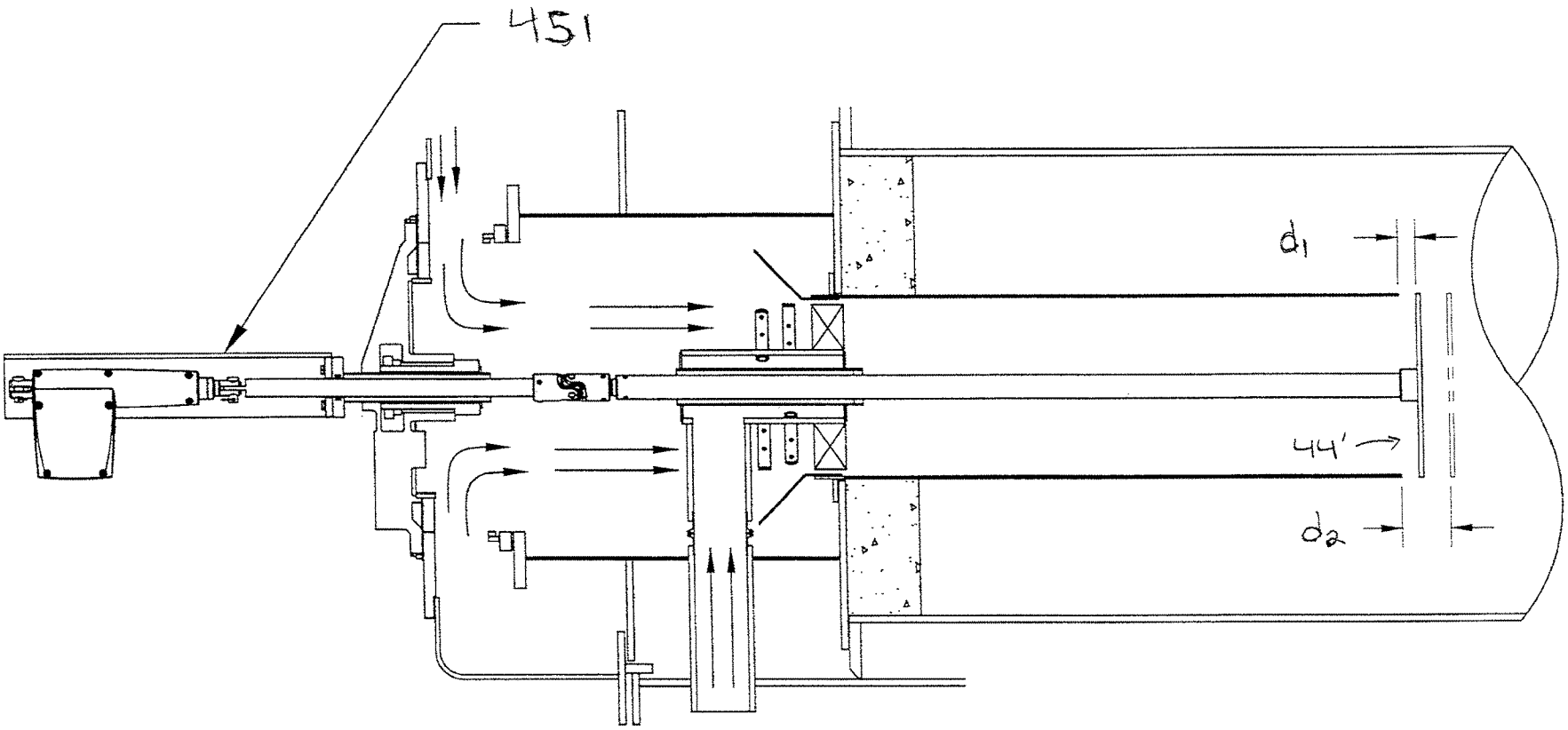
FIG. 8 is a schematic diagram of a boiler system, similar to the boiler system of FIG. 2 showing the system with an exemplary linear actuator assembly for adjusting the end cap, in accordance with one example embodiment encompassed herein.

As shown with respect to FIGS. 7 and 8, the end plate actuator 45' may take a variety of forms, including, for example, a linear actuator 451 or a rotary actuator 452.

As shown in FIG. 10, the first exit 47' is defined by a series of air-fuel discharge openings 71' arranged to lie in circumferentially spaced-apart relation to one another around the circumference of the burner 50'. Illustratively, the series of air-fuel discharge ports 71' is defined by first, second, third and fourth discharge openings 71*a'*, 71*b'*, 71*c'*, 71*d'* that are positioned to lie generally equally spaced-apart to one another. Each air-fuel discharge port 71*a'*, 71*b'*, 71*c'*, 71*d'* is defined the downstream end of the burner 50', the end plate 44' and a set of discharge-plate spacers 73'. The discharge-plate spacers 73' are only to assist with alignment.

As shown with reference to FIG. 10, the set of discharge-plate spacers 73' include, for example, first, second, third and fourth discharge-plate spacers 73*a'*, 73*b'*, 73*c'*, 73*d'* that are positioned to lie in generally equally spaced-apart relation to one another. The discharge spacers 73' cooperate to provide spacer means for separating the detached first flame 40' produced from the first exit 47' to produce a series of circumferentially spaced-apart first flame portions 74' as illustrated, for example, in FIGS. 5-6A. The series of first flame portions includes four first flame portions 74*a'*,74*b'*, 74*c'*, 74*d'* (FIGS. 5-6A), and each pair of first flame portions 74' cooperate to define there between a combustion-products corridor configured to provide means for communicating combined combustion products in a downstream direction.

The second exit 49', as shown perhaps best in FIG. 10, is formed in the end plate 44'. The second exit 49' is defined by a series of staged air-fuel discharge apertures 75' arranged in a tight grouping at a predetermined location on the end plate 44', as shown in FIG. 10. Other patterns of staged air-fuel discharge apertures are possible and contemplated within the scope of the present disclosure. In an embodiment, the series of apertures 75' are located above the pilot tube 89' to permit viewing of the pilot flame, as well as the second flame 41' once the main flame is lit (see FIG. 6A). The attached second flame 41', when a portion of the combustible air-fuel mixture exiting from the second exit 49' is ignited, extends between the center and perimeter edge to initiate and maintain ignition of the detached first flame 40'.

Figure 6B:
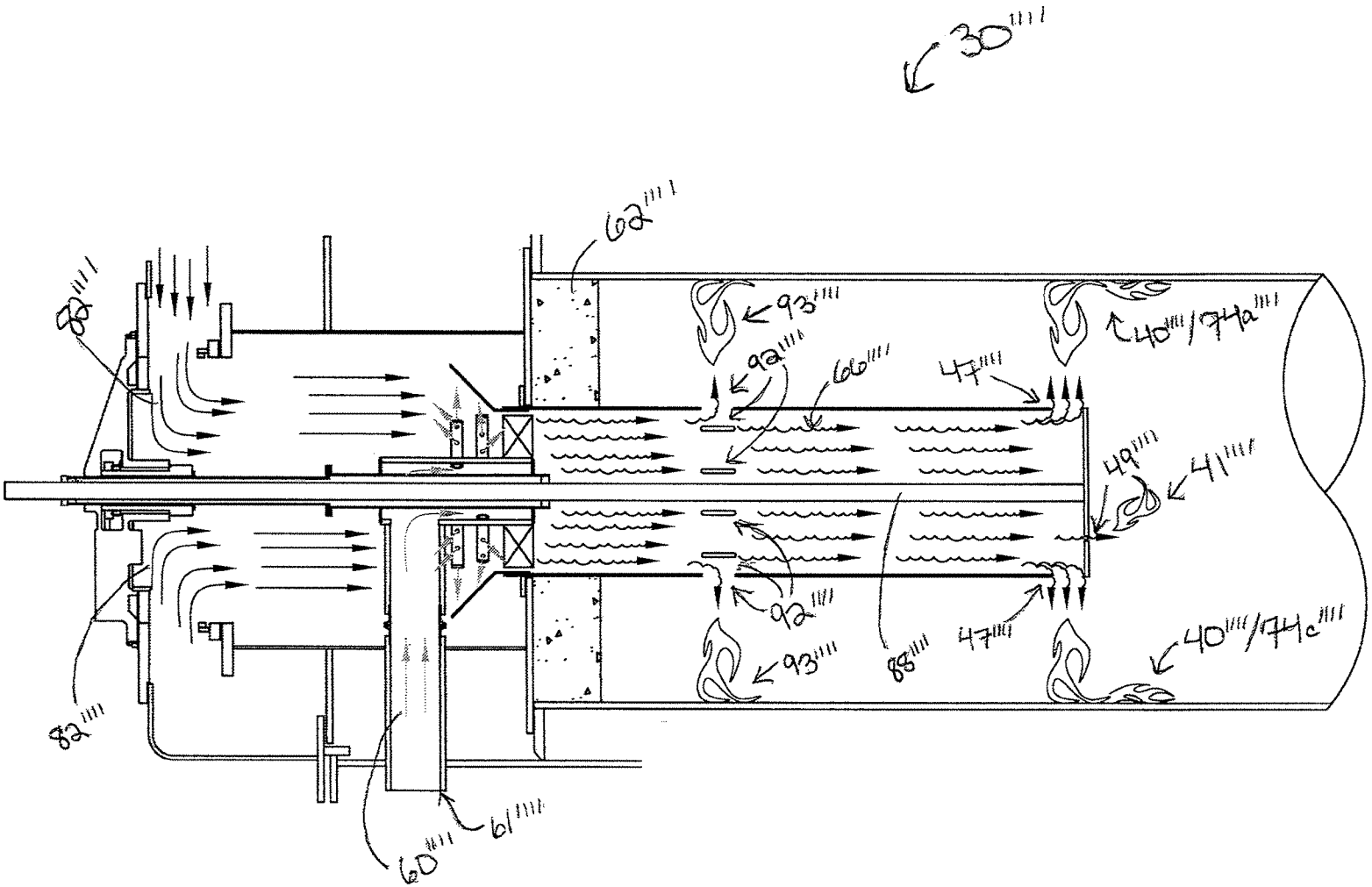
FIG. 6B is a schematic diagram of a boiler system, similar to the boiler system of FIG. 6A, but having an additional exit.

FIG. 6B illustrates an embodiment similar to that described with reference to FIG. 6A, but including yet a third exit 92"", which in the embodiment shown are slots in the burner 50"" wall. As shown in FIG. 6B, third exit 92"" is defined by a series of circumferentially spaced apart slots in the burner 50"" wall. In the embodiment shown, the third exit 92"" includes ten slots, but it is to be understood that the number of slots making the third exit 92"" may vary depending on the size of the slots, the size of the burner 50"" and/or the size of the furnace 30"". Also shown in FIG. 6B is detached third flame 93"". The third exit 92"" communicates combustible air-fuel mixture into the combustion chamber 32"" to establish, when a portion of the combustible air-fuel mixture communicated from the exit 92"" is ignited, a detached third flame 93"" that extends radially outward from the burner 50"". In some embodiments, the detached third flame 93"" may be stabilized on the interior surface of the furnace 30"", as suggested in FIG. 6B.

Although FIG. 6B is described with reference to a boiler system 10"", it is understood that the overall components of the boiler system 10"" are similar or the same as those provided with respect to FIG. 6A. Like parts are labeled with like numbers.

In one embodiment, the first exit 47' is generally configured to communicate about 85% to about 97% of the combustible fuel-air mixture by volume into the combustion chamber 32' depending on whether the furnace 10' is running at low fire or high fire (or somewhere in between). In one embodiment, the first exit 47' is configured to communicated about 85% to about 90% of the combustible fuel-air mixture by volume into the combustion chamber 32' at low fire and about 95% to about 97% of the combustible fuel-air mixture by volume into the combustion chamber 32' at high fire. The second exit 49' is configured to communicate about 3% to about 15% of the fuel-air mixture by volume in the downstream direction (e.g., ultimately into the combustion chamber 32') depending on whether the furnace 10' is running at low fire or high fire (or somewhere in between). In one embodiment, the second exit 49' is configured to communicate about 10% to about 15% of the combustible fuel-air mixture by volume into the combustion chamber 32' at low fire and about 3% to about 5% of the combustible fuel-air mixture by volume into the combustion chamber 32' at high fire.

The first exit 47' is formed in the burner 50' so that the detached first flame combustion products are mixed within the combustible air-fuel mixture flowing through the first exit 47'. The flame combustion products are able to move within the combustion chamber 32' as a result of this combination with the combustible air-fuel mixture and the design of the first exit 47'.

FIGS. 7 and 8 illustrate the different positions of the end plate 44' relative to the burner 50' when in the low fire and high fire positions. As shown, when the furnace 30' is at low fire, the end plate 44' is closer to the burner 50', thereby creating a smaller first exit 47'. In other words, the distance between the end plate 44' and the burner head 52' is $d_1$.

Because the end plate 44' will never be in contact with the burner head 52' (e.g., there will always be a gap between the end plate 44' and the burner head 52'), in an embodiment, the low fire position will be that at which the end plate 44' is as close to the burner head 52' as permitted.

When the burner is at high fire, the end plate 44' is further away from the burner 50', thereby creating a larger first exit 47'. In other words, the distance between the end plate 44' and the burner head 52' is $d_2$, and $d_1$ is less than $d_2$. In an embodiment, when at high fire, the end plate 44' is as far away from the burner 50' as permitted by the actuator 45' or other components of the furnace 30'. As will be appreciated, the end plate 44' will be somewhere between the low fire and high fire positions when at mid fire.

FIG. 5 illustrates an exemplary burner 50' at low fire. The low-fire state of the burner 50' is associated with a volumetric flow that is lower than the maximized volumetric flow of the premix. The low fire state is used, for example, during start-up of the burner 50' to warm the system and minimize thermal shock. After warming is complete, a high fire state may be used or another volumetric flow amount that is between high fire and low fire, depending on the amount of heat needed to be transferred to the adjacent medium.

In an embodiment, low fire is defined as the state of the burner 50' when the end plate 44' is as close to the burner 50' as permitted. In one embodiment, the low fire state is defined as the state of the burner 50' when the end plate 44' is positioned to provide less than or equal to 25% input of premix, by volume, into the combustion chamber 32', based on the volume of premix in the burner 50'. In one embodiment, the low fire state is defined as the state of the burner 50' when the end plate 44' is positioned to provide about 25% input of premix, by volume, into the combustion chamber 32', based on the volume of premix in the burner 50'. In one embodiment, low fire is defined as the state of the burner 50' when the end plate 44' is as close to the burner 50' as permitted, at which position about 25% input of premix, by volume, is provided into the combustion chamber 32', based on the volume of premix in the burner 50'.

FIG. 6A illustrates an exemplary burner 50' at high fire. The high fire state of the burner 50' is associated with maximized volumetric flow of the premix to maximize heat production and, as a consequence, heat transfer to the adjacent medium.

In other words, in one embodiment, high fire is defined as the state of the burner when the end plate 44' is a far from the burner 50' as permitted. In one embodiment, when at high fire, the end plate 44' is positioned to provide 100% of premix, by volume, into the combustion chamber 32', based on the volume of premix in the burner 50'. In one embodiment, when at high fire, the end plate 44' is positioned to provide about 100% of premix, by volume, into the combustion chamber 32', based on the volume of premix in the burner 50'. In one embodiment, high fire is defined as the state of the burner 50' when the end plate 44' is as far from the burner 50' as permitted, at which position about 100% input of premix, by volume, is provided into the combustion chamber 32', based on the volume of premix in the burner 50'.

In an embodiment, the burner 50' also has a mid-fire state which is associated with a volumetric flow of the premix which is between that of the low fire state and the high fire state. For example, in an embodiment, the mid fire state is defined as the state of the burner 50' when the end plate 44' permits about 50% of the total volumetric flow of the premix into the combustion chamber 32', based on the volume of premix in the burner 50'. In a further embodiment, the mid fire state is defined as the state of the burner 50' when the end plate 44' permits 50% of the total volumetric flow of the premix into the combustion chamber 32', based on the volume of premix in the burner 50'. However, in further embodiments, a mid-fire state may correspond to an end plate 44' position which permits about 45% to about 55% of the total volumetric flow of the premix into the combustion chamber 32', based on the volume of premix in the burner 50'.

In one embodiment, when at low fire, the end plate 44' is positioned to provide about 25% input of premix, by volume, into the combustion chamber 32', based on the volume of premix in the burner 50'; when at mid fire, the end plate 44' is positioned to provide about 50% input of premix, by volume, into the combustion chamber 32', based on the volume of premix in the burner 50'; and when at high fire, the end plate 44' is positioned to provide about 100% input of premix, by volume, into the combustion chamber 32', based on the total volume of premix in the burner 50'.

While the industry generally defines the low, mid and high fire states as the states at which about 25%, about 50% and about 100% of the premix, respectively, by volume, is provided into a combustion chamber, based on the total volume of premix in a burner, it is to be understood that these percentages may vary slightly due to burner design/configuration and/or other factors as will be appreciated by one of skill in the art.

It will further be understood and appreciated that the volumetric flow through each of the available exists (e.g., the first exit 47' and second exit 49' in the case of embodiments as shown, for example, in FIGS. 1A-6A or the first, second and third exits 47'''', 49'''', 92'''' in the case of embodiments as shown, for example, in FIG. 6B) varies depending on the fire state of the burner. For example, it will be appreciated that, generally, the first exit 47' conducts more premix into the combustion chamber 32' than does either of the second or third exists 49', 92''''.

Furthermore, the first exit 47' conducts more premix into the combustion chamber 32' at high fire than at low fire. Table A below provides exemplary ranges of the relative amount of premix flow through each of the exits at high and low fire states. Advantageously, as reflected in Table A, the movable end plate permits variation of the premix flow percentages for each of the provided exits (e.g., 2 exits, 3 exits, etc.) by virtue adjusting the end cap position.

TABLE A

| Premix Flow Percentages | | |
|---|---|---|
| | High Fire | Low Fire |
| First Exit (End Plate Gap) | 92-96% | 84-88% |
| Second Exit (End Plate Holes) | 3-6% | 9-12% |
| Third Exit (Firing Tube Slots) | 1-2% | 3-4% |

In an embodiment, the position of the end plate 44' is continually adjustable of the entire range permitted by the actuator 45' and/or other components of the furnace 30'. However, in other embodiments, it is possible for the end plate 44' to have pre-determined and defined positions spanning between the low and high fire positions corresponding to a mid fire position and other pre-determined intermediate fire positions.

As will be appreciated by one skilled in the art, the exact width of the first exit 47' (e.g., distance between the end of the burner 50' and the end plate 44') depends on the dimensions of the burner, and particularly the volume of the burner. Exemplary gap dimensions for two exemplary burner styles are provided in Table B, below.

TABLE B

| End Gap Dimensions for HP Burners | | |
|---|---|---|
| Input | 350 HP (inches) | 500 HP (inches) |
| Low Fire (25%) | 0.75 | 1.00 |
| Mid Fire (50%) | 0.985 | 1.562 |
| High Fire (100%) | 1.680 | 2.625 |

FIGS. 5 and 6A also illustrate the first and second flames 40', 41' produced during the low and high fire states, respectively. The flames 40', 41' are arranged to have varying flame temperatures relative to one another to minimize $NO_x$ formation in the flames. The second flame 41' is configured to have a relatively larger flame temperature relative to the first flame 40. The first flame 40' has a temperature lower than that of the second flame 41' due to the first flame 40' quenching on the interior surface of the heat-transfer tube 32', detachment from the burner 50' and mixing of combined combustion products into the combustible air-fuel mixture coming out of the first exit 47', as described above.

In embodiments, the present boiler systems, such as described, for example, with reference to boiler system 10', are configured to reduce the amount of NOx, and the amount of NOx is dependent on the amount of flue gas recirculation, if any. For example, when the boiler system 10' uses flue gas recirculation, such as, for example, described with reference to FIGS. 1-4 above, the boiler systems are configured to target approximately 15% excess air. When using flue gas recirculation (FGR), the burner 50' can provide less than about 30 ppm, or less than about 10 ppm, or less than about 5 ppm NOx. In an embodiment, when using FGR, the burner 50' can provide from greater than 0 ppm to less than about 5 ppm NOx. In other embodiments in which FGR is not used, the boiler system may use greater than or equal to about 15%, or greater than or equal to about 20%, or greater than or equal to about 30% excess air. In such embodiments in which FGR is not used, the burner 50' can provide less than about 30 ppm to greater than or equal to about 10 ppm NOx. Although the description of the burner provided above and shown with respect to FIGS. 5-8 and 10 is provided with reference to burner 50' and furnace 30' (and, generally, boiler system 10' and its various components), it is understood that the end plates 44/44" are similar to or the same as those described above and function similar to or the same as end plate 44' describe above with reference to FIGS. 5-8 and 10, and, indeed, the boiler systems 10/10" and their various components are similar to or the same as those described with relation to boiler system 10', above, unless specifically described otherwise above.

FIG. 9 is a schematic diagram of boiler system, similar to the boiler system 10 of FIG. 2 showing a the system with an exemplary control assembly 900, in accordance with one example embodiment encompassed herein. As shown in FIG. 9, the boiler system includes a control cabinet 901 which houses the controls and related components which control the various actuators of the boiler system, including the end plate actuator 45, the flue gas recirculation actuator 902, the air damper actuator 903 and the fuel actuator 904. Although the description with respect to FIG. 9 is provided with reference to boiler system 10, it is understood that boiler systems 10'/10" may comprise control systems (e.g., control cabinet, end plate actuator, flue gas recirculation actuator, air damper actuator, fuel actuator) which are similar to or identical to those described with relation to boiler system 10.

Figure 11:
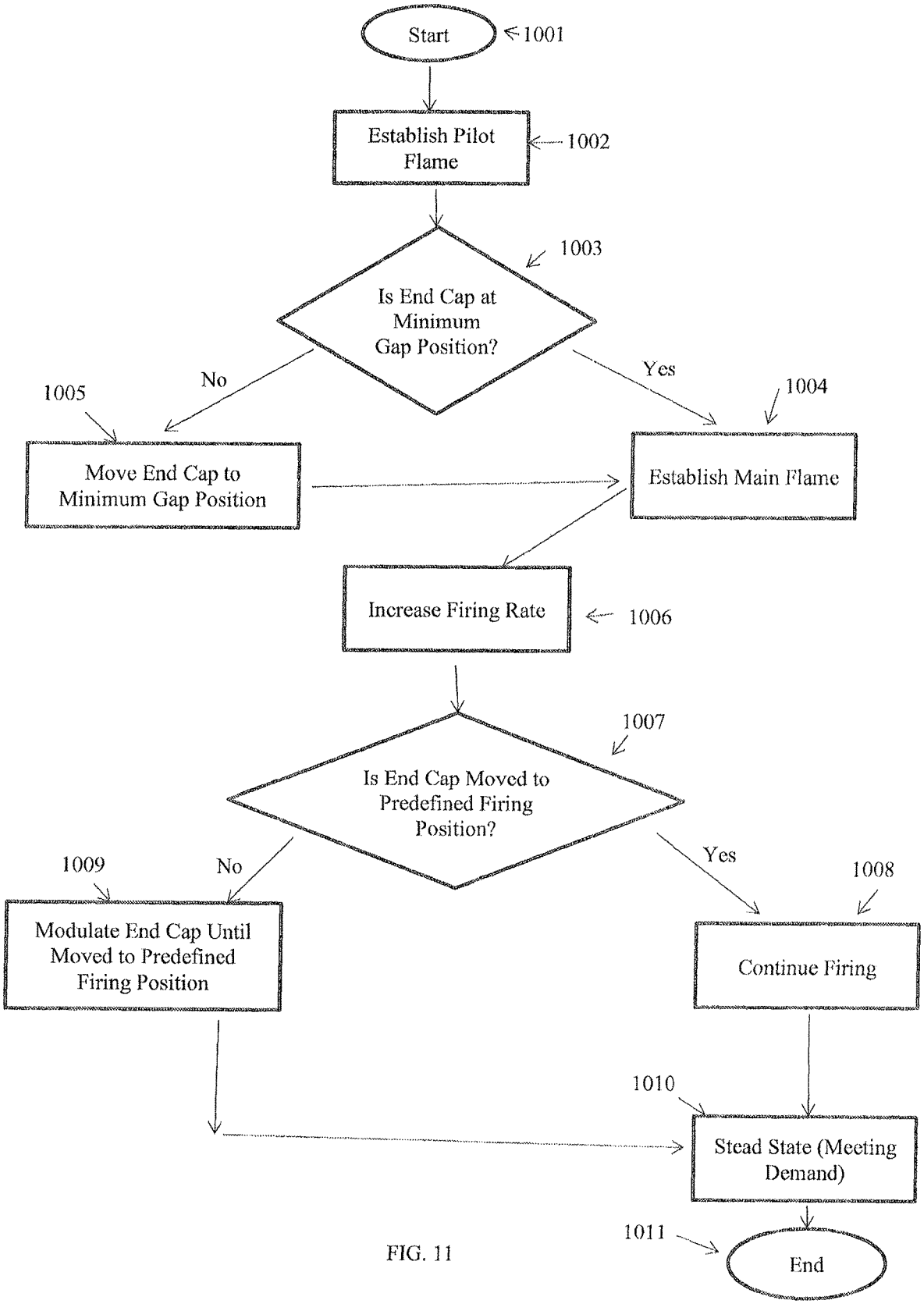
FIG. 11 is a process flow diagram illustrating one or more processes in accordance with example embodiments encompassed herein.

FIG. 11 is a process flow diagram illustrating one or more processes 1000 in accordance with example embodiments encompassed herein. The process(es) start(s) (1001) by establishing the pilot flame. Because the system should be at low fire to establish the pilot flame (to warm the system and minimize thermal shock), the end cap should be at a minimum gap position. Establishing the pilot flame therefore requires a determination of whether the end cap is at a minimum gap position (1003). If yes, then the furnace continues firing to establish the main flame (1004). If not, then the end cap is moved to the minimum gap position (1005) and then the main flame is established (1004).

After warming is complete, a high fire state may be used or another volumetric flow amount that is between high fire and low fire, depending on the amount of heat needed to be transferred to the adjacent medium. In other words, the end cap gap is increased until a desirable (typically predetermined) fire state is reached. The firing rate is therefore increased (1006), and as the firing rate increases, it must be determined if the end cap is moved to a predefined firing position (step 1007). The predetermined firing position corresponds to a desired firing rate as demanded by local system/load. If yes, then firing is continued (1008). If no, then the end cap is modulated until moved to the predetermined firing position (1009). Once the end cap is in the predetermined firing position, the furnace is kept at that steady state to meet the demand (1010) and the process ends (1011).

In an embodiment, the process further comprises adjusting the end cap to a second predefined position in order to adjust the firing rate of the boiler.

In an embodiment, the process further comprises providing a volume of combustible air-fuel mixture to a burner and combusting the combustible air-fuel mixture to produce a flame.

In an embodiment, the process further comprises providing a volume of combustible air-fuel mixture to a burner, combusting at least a portion of the combustible air-fuel mixture to produce a flame, and increasing the firing rate of the boiler system by moving the end cap to a predefined position to adjust the volume of combustible air-fuel mixture exiting the burner.

In an embodiment, the process further includes introducing an amount of recycled flue gas to the combustible air-fuel mixture prior to providing the combustible air-fuel mixture to the burner.

A boiler system may comprise two or more embodiments described herein. Any reference to orientation (e.g., horizontal, vertical, upper, lower, front, rear, and the like) is made with reference to the specific drawing for teaching purposes only and should not be considered limiting.

Embodiments of the present disclosure are further described with reference to the numbered embodiments below:

E1. In an embodiment, a boiler system comprises a housing having a generally cylindrical shape and extending between first and second walls to provide a generally cylindrical space; a fire tube positioned near a bottom of the generally cylindrical housing and extending longitudinally from a first wall of the cylindrical housing to a fire tube end wall; a burner having a generally cylindrical housing and an end plate, the housing defining a generally cylindrical chamber; wherein the fire tube provides a combustion chamber where combustion of an air-fuel mixture is accomplished using the burner, the burner extending into the fire tube; and wherein the end plate of the burner is adjustable so as to adjust the flame that extends from within the burner housing into the fire tube.

E2. The boiler system of E1 further comprising a set of tubes located above a portion of the fire tube and generally spanning a length extending between the first and the second walls of the cylindrical housing. E3. The boiler system of E2, further comprising a chamber providing a space between and connecting the fire tube and the set of tubes. E4. The boiler system of E3, wherein heated combustion gases flow from the fire tube, through the chamber space, and through the set of tubes. E5. The boiler system of one or more of the preceding embodiments, wherein the generally cylindrical housing of the fire tube has an interior surface which is generally smooth. E6. The boiler system of any of E1-E4, wherein the generally cylindrical housing of the fire tube has an interior surface which is corrugated. E7. The boiler system of one or more of the preceding embodiments, wherein an amount of flue gas is recirculated into the combustion chamber after existing the set of tubes. E8. The boiler system of one or more of the preceding embodiments, wherein the end plate of the burner is adjusted using a rotary actuator. E9. The boiler system of any one of E1-E7, wherein the end plate of the burner is adjusted using a linear actuator. E10. The boiler system of any of the preceding embodiments, wherein the burner comprises at least two exits for combustible gases. E11. The boiler system of any of the preceding embodiments, wherein the burner has two exits for combustible gases. E12. The boiler system of any of E10-E11, wherein a first exit comprises a series of discharge openings arranged in circumferentially spaced-apart relation to one another around the circumference of the burner. E13. The boiler system of E12, wherein the series of discharge openings are defined by a downstream end of the burner housing, the end plate, and a set of discharge plate spacers. E14. The boiler system of any of E12-E13, wherein the series of discharges ports comprises four discharge openings. E15. The boiler system of any of E10-E14, wherein a second exit comprises a series of air-fuel discharge apertures through the end plate. E16. The boiler system of E15, wherein the series of air-fuel discharge apertures are arranged in a tight grouping through the end plate. E17. The boiler system of any one of E1-E16, wherein the air-fuel mixture is a premix. E18. The boiler system of any one of E1-E17, wherein the burner is a premix burner which utilized a premix of air and fuel. E19. The boiler system of any one of E17-E18, wherein the end plate of the burner is adjustable so as to adjust the amount of premix exiting the burner, thereby adjusting the flame that extends from within the burner housing into the fire tube.

E20. A burner system for use with a boiler system, the burner system comprising: a burner comprising a burner housing having a generally cylindrical shape and extending from a first end wall to a second end wall; the burner extending into a fire tube of a boiler; wherein the second end wall of the burner housing is adjustable so as to adjust the flame that extends from within the burner housing into the boiler fire tube.

E21. The burner system of E20, wherein the burner comprises at least two exits for combustible gases. E22. The boiler system of any of E20-E21, wherein the burner has two exits for combustible gases. E23. The boiler system of any of E20-E22, wherein a first exit comprises a series of discharge openings arranged in circumferentially spaced-apart relation to one another around the circumference of the burner. E. 24. The boiler system of E23, wherein the series of discharge openings are defined by a downstream end of the burner housing, the end plate, and a set of discharge plate spacers. E25. The boiler system of any of E23-E24, wherein the series of discharges ports comprises four discharge openings. E26. The boiler system of any of E21-E25, wherein a second exit comprises a series of air-fuel discharge apertures through the end plate. E27. The boiler system of E26, wherein the series of air-fuel discharge apertures are arranged in a tight grouping through the end plate.

E28. A process for heating a medium using a boiler system, the process comprising: establishing a main flame by determining whether an end cap of a burner is in a minimum gap position and, if not, moving the end cap to the minimum gap position; increasing the firing rate of the boiler system by moving the end cap to a predefined position; and maintaining firing of the boiler system with the end cap at the predefined position.

E29. The process of E28, further comprising adjusting the end cap to a second predefined position to adjust the firing rate of the boiler. E30. The process of any of E28-E29, further comprising providing a volume of combustible air-fuel mixture to a burner and combusting the combustible air-fuel mixture to produce a flame and increasing the firing rate of the boiler system by moving the end cap to a predefined position to adjust the volume of combustible air-fuel mixture exiting the burner. E31. The process of E30, further comprising introducing an amount of recycled flue gas to the combustible air-fuel mixture prior to providing the combustible air-fuel mixture to the burner. Notwithstanding the above description, it should be appreciated that the present disclosure is intended to encompass numerous other systems, arrangements, and operational processes in addition to those descripted above. In reference to the preceding paragraphs and the aforementioned figures, although various embodiments of the present invention have been described above, it should be understood that embodiments have been presented by way of example, and not limitation. A person of ordinary skill in the art will recognize that there are various changes that can be made to the present invention without departing from the spirit and scope of the present invention. Therefore, the invention should not be limited by any of the above-described example embodiments, but should be defined only in accordance with the following claims and equivalents of the claimed invention presented herein.

What is claimed is:

1. A boiler system comprising:

a boiler housing having a generally cylindrical shape and extending between first and second walls to provide a generally cylindrical space;

a fire tube positioned near a bottom of the generally cylindrical boiler housing and extending longitudinally from a first wall of the cylindrical boiler housing to a fire tube end wall, a burner having a generally cylindrical burner housing and an end plate, the burner housing defining a generally cylindrical chamber;

wherein the fire tube provides a combustion chamber where combustion of an air-fuel mixture is accomplished using the burner, the burner extending into the fire tube;

wherein the end plate of the burner is adjustable between a minimum gap position corresponding to and providing a minimum gap generally located between an end of the cylindrical burner housing and a surface of the end plate facing the end of the cylindrical burner housing, and a predefined position corresponding to and providing a gap between the end of the cylindrical burner housing and the surface of the end plate facing the end of the cylindrical burner housing, such that the gap of the predefined position is larger than the minimum gap, so as to adjust a flame that extends from within the burner housing into the fire tube;

wherein the burner comprises at least two exits for combustible gases, a first exit being formed in at least one of the minimum gap and the gap of the predefined position, the first exit comprising a series of discharge openings arranged in circumferentially spaced-apart relation to one another around the circumference of the burner, the series of discharge openings being defined by a downstream end of the burner housing, the end plate, and a set of discharge plate spacers.

2. The boiler system of claim 1 further comprising a set of tubes located above a portion of the fire tube and generally spanning a length extending between the first and the second walls of the cylindrical boiler housing.

3. The boiler system of claim 2, further comprising a chamber providing a space between and connecting the fire tube and the set of tubes.

4. The boiler system of claim 3, wherein heated combustion gases flow from the fire tube, through the chamber space, and through the set of tubes.

5. The boiler system of claim 1, wherein the generally cylindrical boiler housing has an interior surface which is generally smooth.

6. The boiler system of claim 1, wherein the generally cylindrical boiler housing has an interior surface which is corrugated.

7. The boiler system of claim 1, wherein an amount of flue gas is recirculated into the combustion chamber after existing the set of tubes.

8. The boiler system of claim 1, wherein the end plate of the burner is adjusted using either a rotary or a linear actuator.

9. The boiler system claim 1, wherein the series of discharges ports comprises four discharge openings.

10. The boiler system of claim 1, wherein a second exit comprises a series of air-fuel discharge apertures through the end plate.

11. The boiler system of claim 10, wherein the series of air-fuel discharge apertures are arranged in a tight grouping through the end plate.

12. The boiler system of claim 1, wherein the air-fuel mixture is a premix.

13. The boiler system of claim 1, wherein the burner is a premix burner which utilizes a premix of air and fuel.

14. The boiler system of claim 13, wherein the end plate of the burner is adjustable so as to adjust the amount of premix exiting the burner, thereby adjusting the flame that extends from within the burner housing into the fire tube.

15. A process for heating a medium using the boiler system of claim 1, the process comprising:

establishing a pilot flame by determining whether the end cap of the burner is in the minimum gap position and, if not, moving the end cap to the minimum gap position;

increasing the firing rate of the boiler system by moving the end cap to the predefined position; and maintaining firing of the boiler system with the end cap at the predefined position.

16. The process of claim 15, further comprising adjusting the end cap to a second predefined position to adjust the firing rate of the boiler.

17. The process of claim 15, wherein establishing a pilot flame includes providing a volume of combustible air-fuel mixture to the burner and combusting the combustible air-fuel mixture to produce a flame and increasing the firing rate of the boiler system by moving the end cap to the predefined position adjusts the volume of combustible air-fuel mixture exiting the burner.

18. The process of claim 17, further comprising introducing an amount of recycled flue gas to the combustible air-fuel mixture prior to providing the combustible air-fuel mixture to the burner.

19. A boiler system comprising:

a boiler housing extending between first and second walls;

a fire tube positioned near a bottom of the boiler housing and extending longitudinally from a first wall of the boiler housing to a fire tube end wall, a burner having a burner housing and an end plate, the burner housing defining a generally cylindrical chamber;

wherein the fire tube provides a combustion chamber where combustion of an air-fuel mixture is accomplished using the burner, the burner extending into the fire tube;

wherein the end plate of the burner is adjustable between a minimum gap position corresponding to and providing a minimum gap generally located between an end of the burner housing and a surface of the end plate facing the end of the burner housing, and a predefined position corresponding to and providing a gap between the end of the burner housing and the surface of the end plate facing the end of the burner housing, such that the gap of the predefined position is larger than the minimum gap, so as to adjust a flame that extends from within the burner housing into the fire tube;

wherein the burner comprises a first exit that is formed in at least one of the minimum gap and the gap of the predefined position, the first exit comprising a series of discharge openings, the series of discharge openings being defined by a downstream end of the burner housing, the end plate, and a set of discharge plate spacers, and being arranged in circumferentially spaced-apart relation to one another around the circumference of the burner.

20. The boiler system of claim 19, wherein the burner comprises at least two exits for combustible gases.

* * * * *